US005308303A

United States Patent [19]

Rawls et al.

[11] Patent Number: 5,308,303

[45] Date of Patent: May 3, 1994

[54] RESISTANCE TRAINING MACHINE

[75] Inventors: R. Lee Rawls, Woodinville, Wash.; Jeffrey T. Prince, Grass Valley, Nev.

[73] Assignee: Stairmaster Sports/Medical Products, Inc., Kirkland, Wash.

[21] Appl. No.: 955,667

[22] Filed: Oct. 2, 1992

[51] Int. Cl.[5] ..... A63B 21/08

[52] U.S. Cl. ..... 482/97; 482/100; 482/137; 482/908

[58] Field of Search ..... 482/92, 93, 97, 99, 482/100, 101, 137, 908, 4-9, 135, 136

[56] References Cited

U.S. PATENT DOCUMENTS

| | | | |
|---|---|---|---|
| 3,588,101 | 6/1971 | Jungreis | 482/97 |
| 4,426,077 | 1/1984 | Becker | 482/92 |
| 4,863,161 | 9/1989 | Telle | 482/9 |
| 4,890,830 | 1/1990 | Kern | 482/908 |
| 4,982,955 | 1/1991 | Heasley | 482/100 |
| 5,039,089 | 8/1991 | Lapcovic | 482/97 |
| 5,062,632 | 11/1991 | Dalebout et al. | 482/4 |

*Primary Examiner*—Richard J. Apley
*Assistant Examiner*—Jeanne M. Mollo
*Attorney, Agent, or Firm*—Seed and Berry

[57] ABSTRACT

An exercise device having a coupling member movable by the user between rest and end limit of travel positions, a constant weight, and a weight-lifting arm operatively connected to the weight and movable through a vertical plane to move the weight between rest and elevated positions corresponding to the rest and end limit positions of the coupling member. The device further includes a pivot arm pivotally movable through a pivot arm plane having a user-selectable angular orientation to transmit a selectable force between the coupling member and weight dependent upon the selected angular orientation. A link arm is connected between the pivot arm and the weight-lifting arm to transmit force therebetween. The pivot arm is pivotally attached to a rotatable pivot arm support which is selectively rotated by a lever arm moved by an electric motor and screw arrangement to selectively change the angular orientation of the pivot arm plane. The pivot arm plane is movable into a non-loading horizontal orientation where movement of the pivot arm transmits substantially zero force between the coupling member and the weight-lifting arm. The pivot arm plane is adjustable to produce a true zero weight setting on the coupling member. The exercise device provides infinitely variable adjustment of the loading on the coupling member within the range of possible weight settings even while an exercise is in progress.

64 Claims, 9 Drawing Sheets

RESISTANCE TRAINING MACHINE

TECHNICAL FIELD

The present invention relates generally to a repetitive exercise device, and more particularly, to a machine which uses a variable resistance to train or rehabilitate a muscle or muscle group.

BACKGROUND OF THE INVENTION

Repetitive exercise devices are used to develop muscle strength and coordination through repetitive use. Such devices commonly use weights, hydraulics, fly wheels, or variable length levers to provide a resistance force when a user exercises with the device. One common repetitive exercise device includes a set of weights of equal size arranged in a vertical stack. A selector rod passes through a central aperture on each of the weights, and the selector rod is connected on the upper end to a cable which lifts the rod and any of the weights attached thereto in response to the user lifting, pushing, or pulling on an input member which is connected through various levers and pulleys to the cable. The amount of weight which is lifted by the user depends upon the number of the individual weights which are connected to the selector rod. The weights are generally in ten-pound or twenty-pound increments, and a removable pin is provided which must be manually positioned by the user to pin a selected one of the weights to the selector rod for movement with the rod. Of course, each of the weights positioned above the weight pinned to the selector rod is also lifted with the rod.

Since the individual weights typically weigh ten to twenty pounds, it is only possible to adjust the weight being lifted by the user in relatively large ten-pound or twenty-pound increments. Further, with this arrangement, the weight can only be adjusted when the weights are at rest. Thus, the same weight must be used during an entire exercise extension and return movement even though it would sometimes be desirable to lift with one force and resist return with a greater force, or even vary the weight during the course of the extension or return movement. Further, the user must typically move from the front of the device where exercise is conducted to the side or rear where the stack of weights is located so as to manually reposition the pin each time it is desired to adjust the amount of weight to be lifted. This results in undesirable interruption in the exercise program.

It will therefore be appreciated that there has been a significant need for a repetitive exercise device with an almost infinitely variable weight-loading which can be changed without the user leaving the exercise position at the front of the device. It is preferable that such a device also allow the weight-loading to be changed while the exercise is in progress, not just when the weight is at rest. Preferably, the weight-loading can also be continually adjusted during the course of the exercise so that a desirable weight-loading profile can be established for an exercise movement. Further, the preferred device will allow the weight-loading to be automatically increased and decreased during the course of an exercise program, such as by using a lower weight-loading for several lifts, and gradually increasing the weight-loading to a maximum amount, with subsequent automatic reduction of the weight-loading as programmed by the user. It is also desirable that the preferred device be constructed so that they forces experienced by the user are predictable and controlled. The present invention fulfills these needs, and further provides other related advantages.

SUMMARY OF THE INVENTION

The present invention resides in an exercise device for a human user, including a first member movable by the user between an initial position and a displaced position. The user achieves exercise by the application of a moving force thereto to move the first member from the initial position to the displaced position, and by the application of a resisting force thereto to resist return movement of the first member from the displaced position toward the initial position. The exercise device also includes a resistance member providing a resistance member force resisting movement of the first member from the initial position to the displaced position when the user is applying the moving force, and moving the first member from the displaced position toward the initial position when the user is applying the resisting force.

A conversion member couples a selectable portion of the resistance member force between the first member and the resistance member. The conversion member is restrained to move along a prescribed path having a selectable angular orientation. The angular orientation of the conversion member path is selectively adjustable by the user to a plurality of angular orientations between the first and second end limits of adjustment angular orientations. The conversion member selectively changes the amount of the selectable portion of the resistance force coupled between the first member and the resistance member in proportion to the angular orientation selected for the conversion member path angular orientation. As such, the user moving force required to move the first member from the initial position to the displaced position, and the user resisting force required to resist return movement of the first member from the displaced position toward the initial position, can be selectively increased or decreased by adjusting the conversion member path angular orientation.

The exercise device further includes an adjustment operable to selectively adjust the conversion member path angular orientation between the first and second angular orientations.

In the illustrated embodiments of the invention, the resistance member is a fixed size weight movable between a lowered position and an elevated position. In one illustrated embodiment, the adjustment means includes an angularly adjustable guide which limits movement of the conversion member and thereby defines the conversion member plane. The conversion member path has at least a substantially linear portion.

In another embodiment, the conversion member is a pivot arm connected to pivot about an axis of rotation. The conversion member path is a path through which the pivot arm pivots about the pivot arm axis. The adjustable member selectively angularly moves the pivot arm axis to selectively adjust the conversion member path angular orientation.

The conversion member path is movable into a non-loading orientation where movement of the conversion member transmits substantially zero force between the first member and the resistance member. In the embodiment where the conversion member path is a pivot arm, the pivot arm has a first end portion pivotally connected by a pivot arm pivot connection to a pivot arm support for pivotal movement of the pivot arm within the conversion member plane about a pivot arm axis of rotation. The conversion member plane, when in a maximum loading orientation, is oblique to the orientation of the pivot arm axis of rotation when the pivot arm conversion member plane is in the non-loading orientation. As such, movement of the pivot arm transmits a maximum force between the first member and the resistance member.

The conversion member plane can also be oriented to be in a negative-loading orientation oblique to the orientation of the pivot arm axis of rotation when the conversion member plane is in the non-loading orientation. The angular orientation is to a side of the non-loading orientation such that movement of the pivot arm transmits a force between the first member and the resistance member which at least partially offsets the magnitude of the moving force required by the user to move the first member to less than the force required when the conversion member plane is in the non-loading orientation.

In the one embodiment of the invention, a link arm is attached at one end to the pivot arm and at an opposite end to a second member to transmit force therebetween. The second member is operatively connected to the resistance member. The pivot arm axis of rotation, when the pivot arm plane is in the non-loading orientation, passes substantially through the position whereat the link arm is attached to the second member, such that when the pivot arm plane is in the non-loading orientation, the pivot arm can freely pivot about the pivot arm axis of rotation while transmitting substantially no force to the first member.

The adjustment member is coupled to the pivot arm support and selectively moves the pivot arm support to angularly rotate the conversion member plane and hence the pivot arm axis of rotation. The pivot arm support is pivotally connected by a support pivot connection to a supporting frame member for angular adjustment of the conversion member plane. The adjustable member selectively rotates the pivot arm support about the support pivot connection to selectively adjust the conversion member plane angular orientation.

The adjustment member includes an adjustment arm coupled at a first end to the pivot arm support and coupled at an opposite end to an actuator which is selectively operable to move the adjustment arm second end to produce a rotational force on the pivot arm support to selectively rotate the pivot arm support about the support pivot connection. The adjustable member is operable to adjust the conversion member plane angular orientation when the first member is in a position other than the rest position to selectively vary the selectable force without having first to move the first member to the rest position.

The adjustable member is operable to adjust the conversion member plane angular orientation while the first member is moving between the rest and end-limit positions to selectively vary the selectable force. The conversion member plane is angularly adjustable to infinitely variable angular orientations between the first and second end limit of adjustment angular orientations in response to operation of the adjustable member.

The exercise device further includes a programmable controller which controls operation of the adjustable member according to a user-selected exercise program including a preselected pattern for the selectable force to be transmitted by the conversion member. The controller includes a user-operated input by which the user can enter the program and an actuator operated in accordance with the program to control the adjustable member to adjust the conversion member plane angular orientation to produce the preselected pattern for the selectable force.

The controller also operates the adjustable member according to a user-selected value for the selectable force, and the user-operated input can be used by the user to select the desired value for the selectable force. Control means are also provided for determining the value of the conversion member plane angular orientation which will produce the desired value for the selectable force. Also included is an actuator responsive to the control means to control the adjustable member to adjust the conversion member plane angular orientation to an angular orientation which produces the desired value for the selectable force.

Other features and advantages of the invention will become apparent from the following detailed description, taken in conjunction with the accompanying drawings.

DETAILED DESCRIPTION OF THE INVENTION

Figure 1:
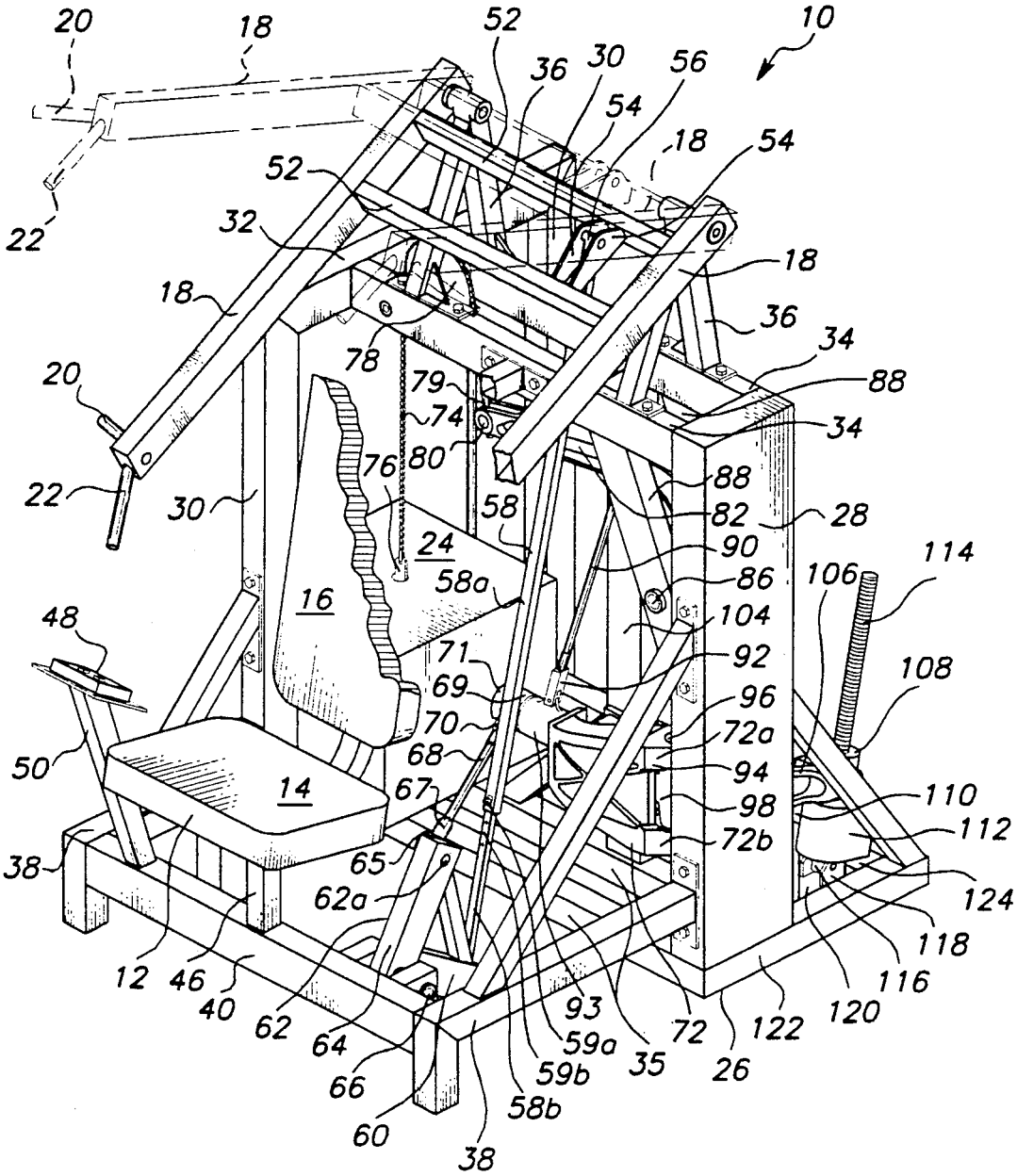
FIG. 1 is a left side isometric, fragmentary view of a repetitive exercise device embodying the present invention.

As shown in the drawings for purposes of illustration, the present invention is embodied in a repetitive exercise device, indicated generally by the reference 10. In the illustrated embodiment of the invention shown in FIG. 1, the exercise device 10 is configured for a human user to exercise by sitting in an adjustable seat 12 having a seat bottom 14 and a back rest 16. A pair of left and right lifting arms 18 extend forward from behind the seat 12 and terminate at a position thereabove. Each of the lifting arms 18 has a pair of handles 20 and 22 (illustrated for only the right lifting arm in solid line, but for both in phantom line) for grasping by the corresponding hand of the user sitting in the seat 12. Exercise is achieved by grasping a desired one of the handles 20 or 22 of each of the lifting arms 18 while sitting in the seat 12, and then pushing upward toward an upper end limit of travel for the lifting arms (shown in phantom line) to apply a moving force to the lifting arms to overcome a loading force applied thereto by a fixed size weight 24. This is known as a concentric motion. The weight 24 is coupled to the lifting arms 18 in a manner in accordance with the present invention to provide an infinitely variable loading force, as will be described in detail below. The application of a moving force to the lifting arms 18 greater than the loading force results in lifting of the weight 24 upward. Exercise is also achieved by applying an upwardly directed resisting force to the lifting arms 18 less than the loading force to resist their downward return movement toward a rest position in response to the loading force applied thereto as the weight 24 moves downward. This is known as eccentric motion.

It is noted that while the exercise device 10 is described in terms of an upper body exercise machine where the user's arms are used to move and resist movement of the lifting arms 18, the present invention is equally applicable to devices where the user sits in the seat 12 and uses the legs to move and resist movement of a lifting bar, and to any other type of device where the user achieves exercise by lifting, pushing or pulling a user-engageable coupling member to apply a moving or resisting force thereto. Further, it should be appreciated that while the invention is described herein with the loading force being supplied by the weight 24, the loading force can alternatively be supplied by a spring, pneumatic cylinder, or any other device which may be coupled to the coupling member such that a moving or resisting force applied thereto by the user will cause the user to achieve exercise.

As best shown in FIG. 1, the exercise device 10 includes a floor engaging support frame 26. The frame 26 has a left side vertical post 28, and a pair of right side forward and rearward vertical posts 30. A pair of right side upper and lower horizontal beams 32 extend between the right side vertical posts 30 to form a rectangular right side frame assembly. A pair of upper cross-beams 34 extend between the right side upper horizontal beam 32 and an upper end of the left side vertical post 28. A pair of lower cross-beams 35 extend between the right side lower horizontal beam 32 and a lower end of the left side vertical post 28. A pair of left and right stands 36 extend upwardly from the upper cross-beams 34 and each has a rearward end of a corresponding one of the left and right lifting arms 18 pivotally attached thereto for simultaneous vertical movement of the lifting arms.

A pair of left and right side horizontal beams 38 extend forwardly from a lower end of the left side vertical post 28 and the right side forward vertical post 30, and a front cross-beam 40 extends between the forwardmost ends of the left and right side horizontal beams 38. The seat 12 is connected at a laterally centered position to the front cross-beam 40 by a seat support post 46. An electronic control panel 48 is positioned on the right side of the seat 12 and supported by a post 50 connected to the front cross-beam 40. The weight 24 is positioned behind and to the right side of the seat 12, at a position over the lower cross-beams 35.

The lifting arms 18 are rigidly interconnected by a pair of cross members 52. A pair of plates 54 are connected between the cross members 52, and support a pivot pin 56 which extends therebetween. An elongated link member 58 is pivotally attached at an upper end to the pivot pin 56, and at a lower end to a lower arm 60 of an L-shaped crank 62 by a pivot pin 63 (shown in FIGS. 2 and 3). The link member 58 is constructed in two telescoping parts **58*a* and 58*b* with a detent pin 59*a* and a plurality of holes 59*b* which allow adjustment of the length of the link member 58 to allow elevational adjustment of the lifting arms 18 to different positions at which an exercise typically begins. The crank 62 includes an upper arm 64, and has a corner portion pivotally attached to the front cross-beam 40 at a position on the left side of the seat 12 by a pivot pin 66** for simultaneous rotation of both arms through a vertical plane.

Figure 2:
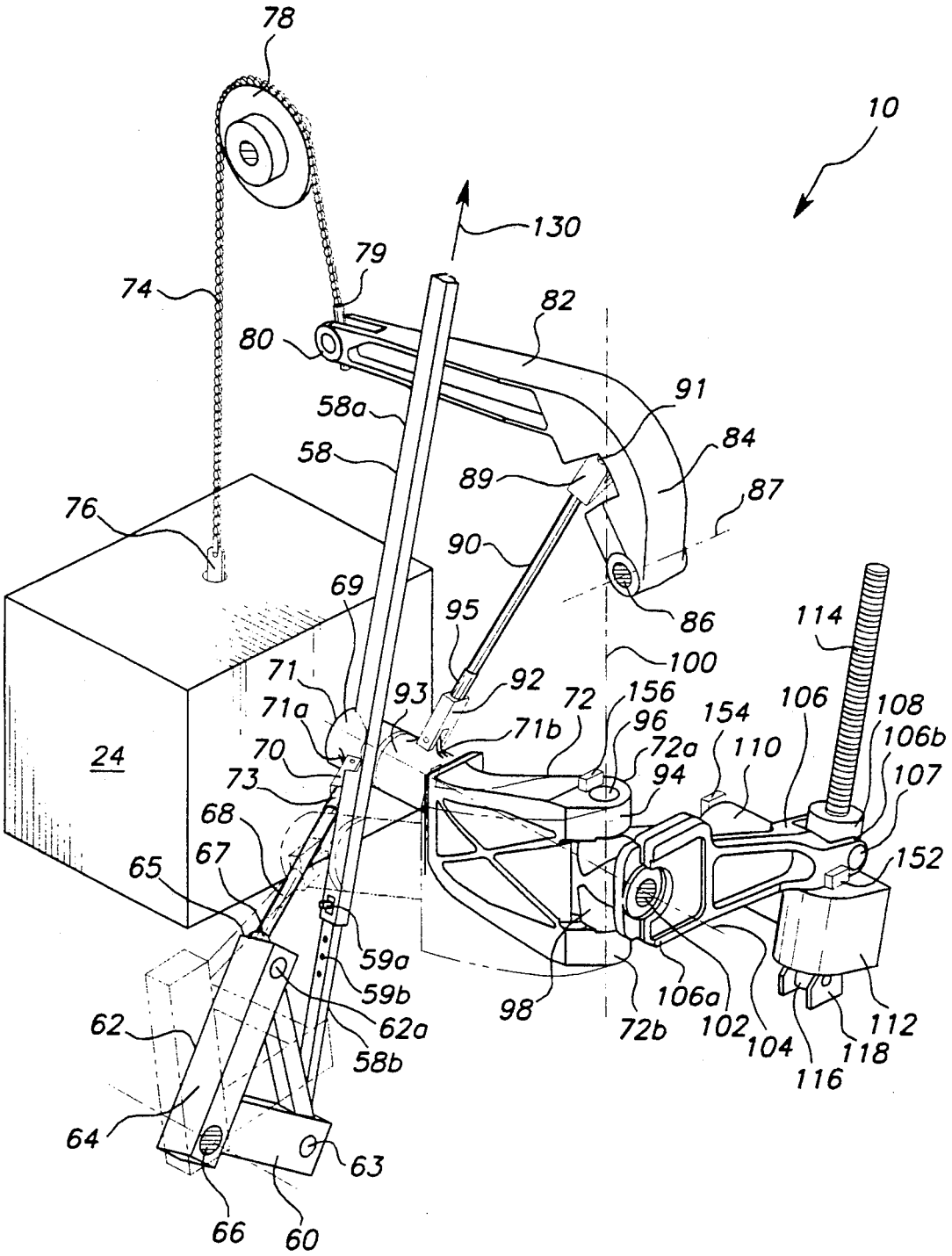
FIG. 2 is an enlarged left side isometric, fragmentary view of the exercise device of FIG. 1 showing the pivot arm thereof with a non-loading horizontal pivot arm plane angular orientation.
Figure 3:
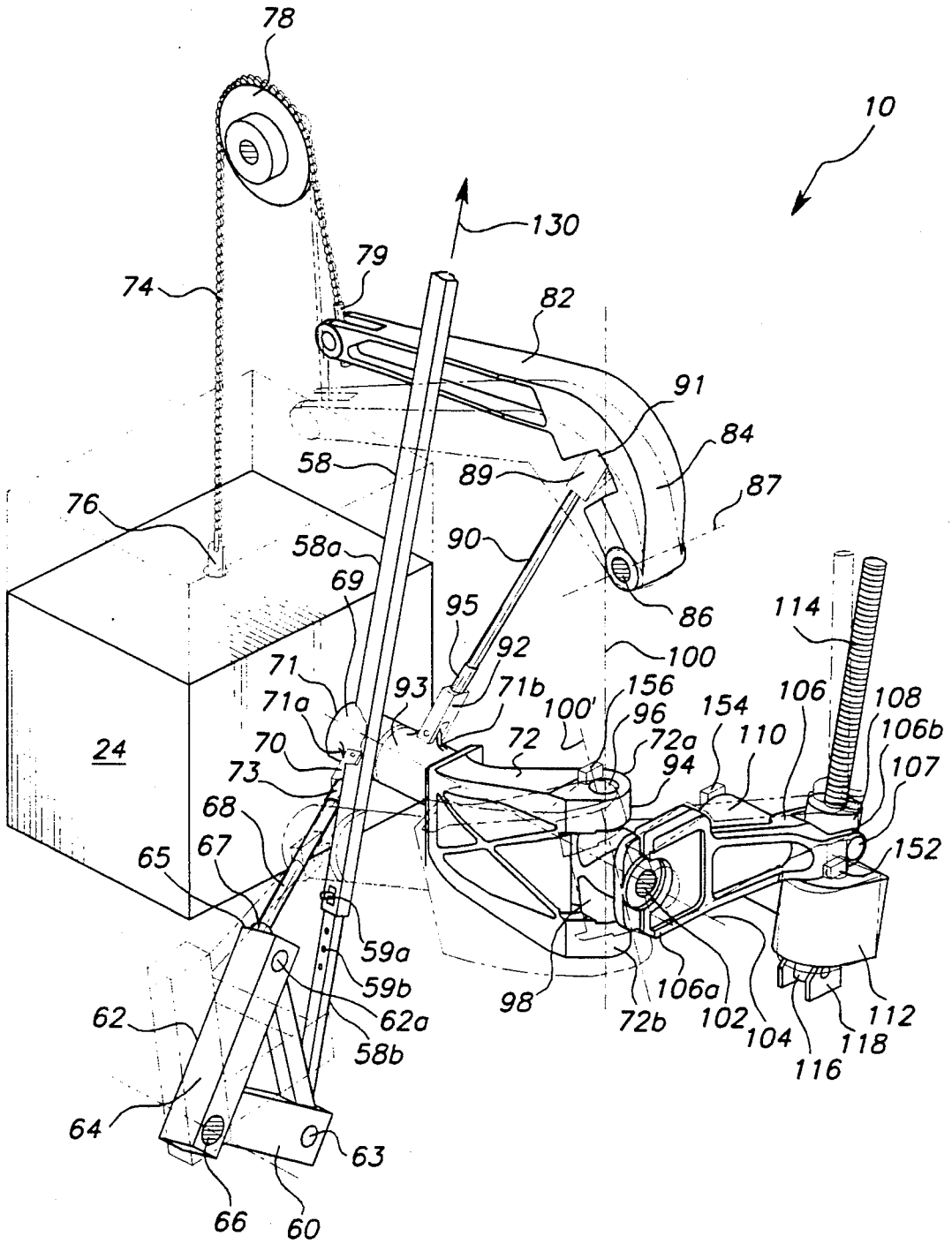
FIG. 3 is an enlarged left side isometric, fragmentary view of the exercise device of FIG. 1 showing the pivot arm thereof with a downwardly tilted pivot arm plane angular orientation.

With this arrangement, when the user applies a moving force to the lifting arms 18 to pivot them upward, the link member 58 is lifted upward with the lifting arms. This causes the crank 62 to rotate counterclockwise when viewed from the left side of the frame 26. One end of a link rod 68 has a clevis coupler 65 pivotally connected to a pin **62*a* carried by the upper crank arm 64. The clevis coupler 65 includes a thrust bearing 67 which allows the link rod 68 to rotate relative thereto. As best shown in FIGS. 2 and 3, the other end of the link rod 68 has a clevis coupler 70 pivotally connected to an ear 71*a* of a bearing-supported outer collar 69 rotatably carried on a free end portion 71 of a pivot arm 72. The clevis coupler 70 also includes a thrust bearing 73 (see FIGS. 2 and 3) which allows the link rod 68 to rotate relative thereto. With this arrangement, three degrees of freedom of movement are provided to accommodate the motion of the link rod 68 that results during operation of the exercise device 10. The above-described counterclockwise rotation of the crank 62 transmits a forwardly directed force through the link rod 68 to the pivot arm 72** to rotate it forward.

Conversely, rearward movement of the pivot arm 72 is transmitted through the link rod 68 to the crank 62, and produces clockwise rotation of the crank which transmits a downward force through the link member 58 to the lifting arms 18. As will be described in more detail below, the weight 24 is coupled to the pivot arm 72 in a manner that the full weight loading of the weight 24 is always applied to the pivot arm, however, the amount of loading force coupled through the pivot arm to the lifting arms 18 is dependent upon the user-selected angular orientation of a pivot arm plane through which the pivot arm is restrained to rotate during use of the exercise device 10.

The weight 24 is connected to the pivot arm 72 through a chain 74 which at all times suspends the weight above and out of contact with the lower cross-beams 35 and the ground. The chain 74 has one end 76 attached to the weight 24 and is entrained on and passes over a sprocket 78, which is rotatably mounted between the upper cross members 34 toward the side of the frame 26 toward the vertical posts 30. The other end 79 of the chain 74 is attached to a free end 80 of a weight-lifting arm 82. The weight-lifting arm 82 is pivotally attached at an opposite end 84 (shown in FIGS. 2 and 3) by a pivot pin 86 between a pair of left side corner braces 88 which each extend between the left side vertical post 28 and a different one of the upper cross-beams 34. The pivot pin 86 defines an axis of rotation 87 for the weight-lifting arm 82 which pivots through a vertical plane.

As best shown in FIGS. 2 and 3, a link rod 90 has a clevis coupler 89 pivotally connected by a pivot pin 91 to the weight-lifting arm 82 at a position intermediate its free end 80 and its opposite end 84 which is connected by the pivot pin 86 to the frame 26. The other end of the link rod 90 has a clevis coupler 92 pivotally connected to an ear **71*b* of a bearing-supported inner collar 93 rotatably carried on the free end portion 71 of the pivot arm 72, inward of the outer collar 69. The clevis coupler 92 also includes a thrust bearing 95 which allows the link rod 90 to rotate relative thereto. With this arrangement, three degrees of freedom of movement are provided to accommodate the motion of the link rod 90 that results during operation of the exercise device 10. The outer and inner collars 69 and 93 are mounted to rotate about the longitudinal axis of the pivot arm free end portion 71**, but restrained against longitudinal movement relative to the pivot arm.

The pivot arm 72 has at an end 94, located opposite the free end portion 71, a pair of clevis ears **72*a* and 72*b* by which the pivot arm is pivotally connected to a pivot pin 96 of a pivot arm support 98. The pivot arm 72 rotates about an axis of rotation 100 (shown in phantom line in FIGS. 2 and 3) defined by the pivot pin 96. Rotational movement of the pivot arm 72 is thereby restrained to within the pivot arm plane previously mentioned which is always perpendicular to the axis of rotation 100. As also previously mentioned, the angular orientation of the pivot arm plane relative to the frame 26 can be selectively adjusted by the user. This is accomplished by selectively rotating the pivot arm support 98 to a desired rotational position relative to the frame 26. The pivot arm support 98 is rotatably mounted on a horizontally oriented pivot pin 102 (shown in FIGS. 2 and 3) which extends between the left side vertical post 28 and a central vertical post 104. The central vertical post 104 extends between the rearward upper and lower cross-beams 34 and 35**.

The pivot pin 102 defines an axis of rotation 104 (shown in phantom line in FIGS. 2 and 3) for the pivot arm support 98. The axis of rotation 104 for the pivot arm support 98 is always oriented perpendicular to the axis of rotation 100 for the pivot arm 72. Hence, the pivot arm is always oriented parallel to and in the pivot arm plane through which the pivot arm 72 moves during operation of the exercise device 10, with the angular orientation of the pivot arm plane relative to the frame 26 being dependent upon the rotational position selected by the user for the pivot arm support 98. The angular orientation of the pivot arm plane can be selectively changed as desired by simply rotating the pivot arm support 98 to a different rotational position.

Rotation of the pivot arm support 98 between selected rotational positions, and hence adjustment of the angular orientation of the pivot arm plane is accomplished using an adjustment lever arm 106. As shown in FIGS. 2 and 3, the lever arm 106 has a first end **106*a* fixedly attached to the pivot arm support 98 and an opposite second end 106*b* pivotally attached by pivot pins 107 to a traveler nut 108. A clockwise or counterclockwise movement of the second end 106*b* of the lever arm 106 results in respective clockwise or counterclockwise rotational movement of the pivot arm support 98 about its axis of rotation 104**.

Movement of the lever arm 106 to adjustably rotate the pivot arm support 98 is achieved by selectively operating a reversible electric motor 110 (see FIGS. 2 and 3) to provide rotational drive through a gear transmission 112 to a rotatable screw 114. The traveler nut 108 is threadably received on the screw 114. The electric motor 110 is fixedly attached to the gear transmission 112, and the gear transmission has a lower mounting flange 116 which is pivotally attached to a bracket 118. The bracket 118 is fixedly attached to a corner plate 120 of the frame 26, as shown in FIG. 1. The corner plate 120 extends between a left side horizontal beam 122 that extends rearwardly from the lower end of the left side vertical post 28, and a rear crossbeam 124 that extends between the rearwardmost end of the left side horizontal beam 122 and the rearward vertical post 30.

Rotation of the screw 114 by operation of the electric motor 110 in one rotational direction causes the traveler nut 108 to move down the screw 114, hence producing clockwise movement of the lever arm 106 and clockwise rotational movement of the pivot arm support 98. This results in clockwise adjustment of the angular orientation of the pivot arm plane when viewed from the left side of the frame 26. Operation of the electric motor 110 in an opposite rotational direction causes the traveler nut 108 to move up the screw 114, hence producing counterclockwise movement of the lever arm 106, the pivot arm support 98, and the pivot arm plane. Changes in the angular orientation of the pivot arm plane are achieved gradually, with infinitely variable changes in orientation achievable within the overall range of travel possible for the traveler nut 108 along the length of the screw 114. The speed of movement and hence the speed of angular adjustment of the pivot arm plane is dependent upon the speed of the electric motor and the thread size selected for the screw 114 and traveler nut 108.

When the electric motor 110 is not operated, the traveler nut 108 remains stationary on the screw 114 and the lever arm 106 holds the pivot arm support 98 stationary in the rotational position to which moved. Hence, the angular orientation of the pivot arm plane is held fixed and, as will be described below, the loading force coupled by the pivot arm 72 through the link rod 68, the crank 62, and the link member 58 to the lifting arms 18 is fixed at a corresponding amount until the angular orientation of the pivot arm plane is changed. While the angular orientation of the pivot arm plane, and thus the loading force coupled to the lifting arms 18, can be held fixed during the course of movement of the lifting arms, the angular orientation can also be varied during their movement by selective operation of the electric motor 110.

It is noted that there is an upper end limit of travel position for the lifting arms 18 beyond which the exercise device 10 will not allow the lifting arms to move. There is also a lower end limit of travel which is usually considered to be the rest position below which the exercise device 10 will not allow the lifting arms 18 to move. In the illustrated embodiment, these limits are set by the pivot arm 72 engaging stops (not shown) which limits clockwise and counterclockwise rotation of the crank 62. An exercise cycle is used herein to be an upward movement of the lifting arms 18 from a rest position to a desired position, and a return movement of the lifting arms to the rest position. As used herein, the rest position need not coincide with the lower end limit of travel for the lifting arms 18. Similarly, the desired position to which the lifting arms 18 are moved before return movement begins need not coincide with the upper end limit of travel for the lifting arms 18.

When the angular orientation of the pivot arm plane is held fixed, exercise is achieved by the user applying moving and resisting forces to the lifting arms 18 with the loading force coupled thereto constant during the exercise cycle. The angular orientation of the pivot arm plane, however, can be selectively varied at any time during an exercise cycle or between cycles so that the loading force coupled to the lifting arms 18 is varied as desired. There is no need to wait for the lifting arms 18 and the weight 24 to return to their rest positions. For example, by appropriately timed operation of the electric motor 110 the angular orientation of the pivot arm plane, and hence the loading force coupled to the lifting arms 18, can be varied to increase the loading force as the lifting arms move upward toward their upper end limit of travel, with the loading force decreased as the lifting arms approach the upper end limit of travel or some other preselected position before the upper end limit. Also, the loading force can be changed again for the return movement of the lifting arms 18 toward their lower end limit of travel.

In such manner, the loading force that must be overcome by the user applying the moving force during an upward arm extension can be varied during the arm extension movement, and then adjusted again so that the user must apply a different resisting force when resisting the downward return movement of the lifting arms 18.

As will be described in more detail below, the user can select or customize an exercise program where the loading force is automatically changed during the course of the exercise program, with the loading force varying at selected times during each exercise cycle or at selected times during the overall program, or both, as desired. A simple exercise program might use one loading force for a preselected number of exercise cycles, and then increase or decrease the loading force used for subsequent exercise cycles according to a desired pattern. The pattern is selected by the user preprogramming the exercise device 10 or selecting values for a preexisting standard exercise program, or by simply manually changing the loading force during the course of the exercise program. This is accomplished using the control panel 48 without moving from the seat 12. As will be described below, the exercise device 10 can also sense performance of an existing selected exercise program, and if the preset number of complete exercise cycles is not achieved by the user, the exercise device will alter the loading force used during the program as appropriate for the next time the user selects that exercise program.

The operation of the pivot arm 72 and how the adjustment of the pivot arm plane varies the loading force will now be described with reference to FIGS. 2–7. The exercise device 10 is shown in FIG. 2 with the pivot arm support 98 rotated into a rotational position with the axis of rotation 100 of the pivot arm 72 orientated substantially vertically. When in this position, the pivot arm plane, through which the pivot arm 72 is restrained to rotate about the pivot pin 96 during use of the exercise device 10, has a substantially horizontal angular orientation. A corresponding view of the pivot arm 72 from the right side showing the free end portion 71 thereof is provided by FIG. 4, with the pivot arm plane represented by a line 132.

Referring again to FIG. 2, the pivot arm 72 is illustrated in solid line in the position corresponding to the rest position for the lifting arms 18, and in phantom line in the position corresponding to a displaced raised position of the lifting arms. When the lifting arms 18 are moved upward by the user, an upwardly directed force, indicated by arrow 130, is transmitted by the lifting arms 18 to the link member 58. This causes the crank 62 to rotate counterclockwise when viewed from the left side of the frame 26, and through the link rod 68 applies a forwardly directed force on the pivot arm 72. As will be explained below, when the pivot arm plane has a horizontal, angular orientation, no loading force is coupled to the link rod 68 and the pivot arm 72 is free to rotate without having to overcome any of the weight load of the weight 24.

This condition exists when the pivot arm 72 is in the horizontal angular orientation because the link rod 90 is pivotally attached to the weight-lifting arm 82 by the pivot pin 91 at a point which is in line with the axis of rotation 100 of the pivot arm 72. It is also noted that the weight-lifting arm 82 pivots about the pivot pin 86 through a vertically oriented plane parallel to and coincident with the axis of rotation 100 of the pivot arm 72. Thus, the distance between the pivot pin 91 and the point where the link rod 90 is attached to the pivot arm 72 remains constant as the pivot arm is moved through the horizontal pivot arm plane. In other words, movement of the pivot arm 72 in response to the user moving the lifting arms 18 will produce no vertical upward or downward pivotal movement of the weight-lifting arm 82 or any corresponding movement of the weight 24. When in the horizontal pivot arm plane, the entire weight load of the suspended weight 24 applied to the weight-lifting arm 82 is transmitted through the link rod 90 to the pivot arm 72, but no loading force is transmitted from the pivot arm to the link rod 68 (i.e., the force the weight 24 creates on the pivot arm has no horizontal component).

Figure 4:
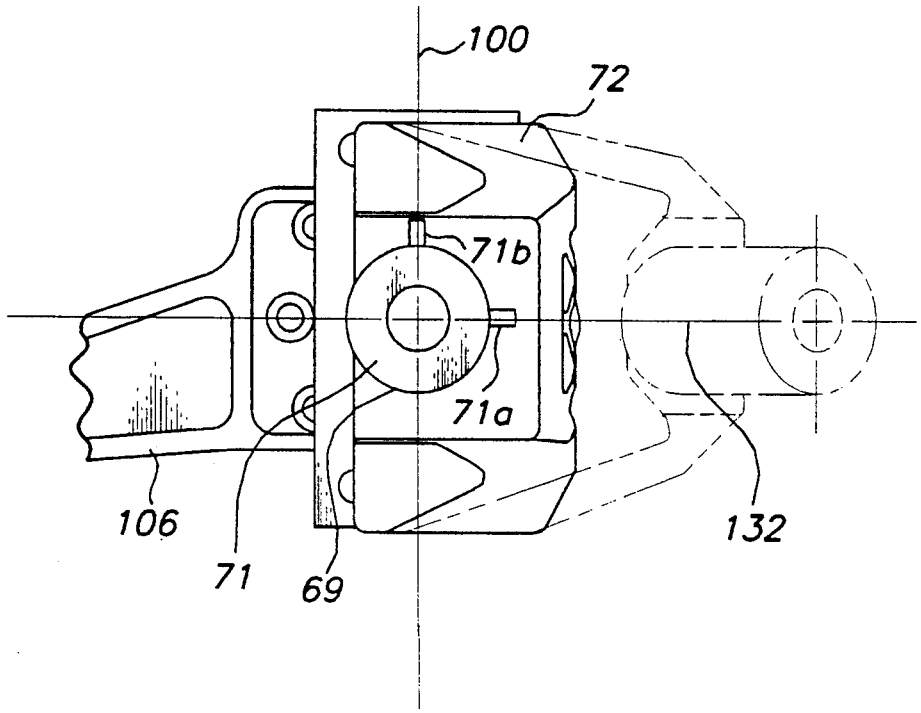
FIG. 4 is an enlarged fragmentary view of only the lever arm and the pivot arm shown of the exercise device of FIG. 1 in the non-loading horizontal pivot arm plane angular orientation of FIG. 2.

The loading force coupled through the pivot arm 72 to the link rod 68 and ultimately to the lifting arms 18 can be selectively and gradually increased by tilting of the pivot arm plane downward relative to the non-loading horizontal angular orientation shown in FIGS. 2 and 4. As described above, this is accomplished by operation of the electric motor 110 to cause the lever arm 106 to rotate counterclockwise, producing counterclockwise rotation of the pivot arm support 98 about its axis of rotation 104. This re-orients counterclockwise the axis of rotation 100 for the pivot arm 72 to a new orientation indicated by reference numeral 100' in FIGS. 3 and 5. Of course, this also changes the angular orientation of the pivot arm plane through which the pivot arm 72 is restrained to move, which is represented by a line 132' in FIG. 5 tilted downward from the horizontal line 132. When so adjusted, the axis of rotation 100' of the pivot arm 72 no longer passes through the point at which the link rod 90 is pivotally attached by the pivot pin 91 to the weight-lifting arm 82 and the pivot arm plane is oblique to the vertical plane through which the weight-lifting arm 82 pivots.

As best illustrated in FIG. 3, when the lifting arms 18 are moved upward by the user, the upwardly directed force, indicated by the arrow 130, is transmitted through the crank 62 and the link rod 68 to the pivot arm 72. This applies a forwardly directed force on the pivot arm 72, in the same manner as described above. Since the movement of the pivot arm 18 is restrained to the tilted pivot arm plane 132', the forward movement also results in downward movement of the free end portion 71 of the pivot arm, shown in FIG. 5 by the arrow 134. Since the link rod 90 has a fixed length, the downward movement of the pivot arm free end portion 71 is transmitted to the weight-lifting arm 82. Downward movement of the weight-lifting arm 82 transmits through the chain 74 an upwardly directed force to the weight 24, causing the weight to be lifted. Thus, at least a portion of the weight load of the weight 24 is effectively coupled through the pivot arm 72 as a loading force on the link rod 68 and thereby on the lifting arms 18. The amount of the coupled loading force increases as the angular orientation of the pivot arm plane is tilted further downward from the horizontal plane 132.

As previously noted, the amount of rotation of the pivot arm support 98, and hence the degree of tilting of the angular orientation of the pivot arm plane that results, is dependent upon the position to which the traveler nut 108 is driven up or down the screw 114 by operation of the electric motor 110. The adjustment can be as little as a fraction of a degree to as large an angular movement as permitted by the physical construction constraints of the exercise device 10. The greater the downward tilting of the angular orientation of the pivot arm plane from the non-loading horizontal orientation, the greater the amount of loading force coupled through the pivot arm 72 to the link rod 68, and hence to the lifting arms 18, and correspondingly, the greater the moving force required by the user to move the lifting arms upward, and the greater the resisting force required by the user to resist their downward return movement. The amount of force coupled between the pivot arm 72 and the link rod 68 varies as a function of the tangent of the angular displacement (indicated by the double-headed arrow 136 in FIG. 5) of the pivot arm plane from the non-loading horizontal orientation. It is again noted that, while the amount of loading force coupled between the pivot arm 72 and the link rod 68 varies depending upon the angular orientation of the pivot arm plane, the pivot arm is always under the full weight load created by the weight 24, since the weight 24 is always in a raised position, even when the weight-lifting arm 82 is in a position corresponding to the rest position of the lifting arms 18.

Figure 5:
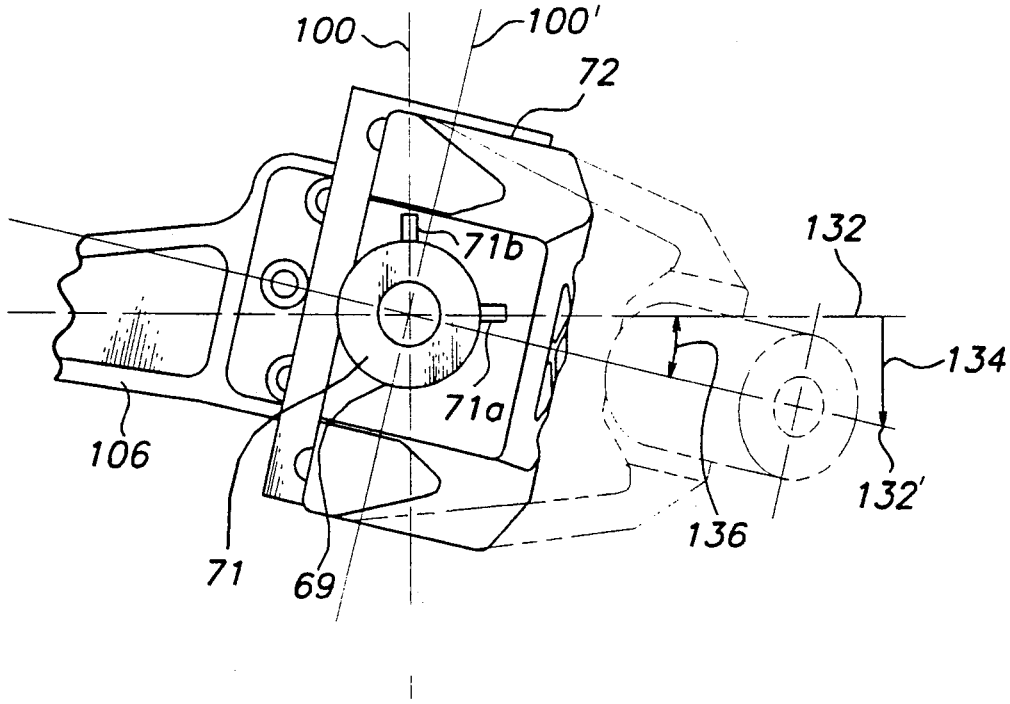
FIG. 5 is an enlarged fragmentary view of only the lever arm and the pivot arm shown of the exercise device of FIG. 1 in the downwardly tilted pivot arm plane angular orientation of FIG. 3.

As described above, tilting the pivot arm plane below the non-loading horizontal orientation as shown in FIGS. 3 and 5 increases the amount of the loading force coupled through the pivot arm 72 to the lifting arms 18. The pivot arm plane can also be tilted upward so that it is at an angular orientation above the non-loading horizontal orientation with the pivot arm plane oblique to the vertical plane through which the weight-lifting arm 82 pivots. This is also accomplished by operation of the electric motor 110 to rotate the lever arm 106 clockwise. When moved above the non-loading horizontal orientation, the pivot arm 72 couples a negative loading force which tends to push the link rod 68 forward to assist the user in lifting the lifting arms 18 upward. The electric motor 110 can be operated so that the pivot arm plane is rotated sufficiently above the non-loading horizontal orientation that the negative loading force coupled through the pivot arm 72 to the lifting arms 18 is sufficient to substantially balance the inherent weight and friction of the lifting arms and the other components attached thereto to achieve a zero pound force minimum weight setting for the exercise device 10.

With the present invention, the user of the exercise device itself can select a weight setting (i.e., the resistance force the user experiences when moving the lifting arms 18) anywhere from substantially zero pounds to the maximum loading force the particular construction of the exercise device 10 can couple through the pivot arm 72 to the lifting arm, or any value therebetween. In the illustrated embodiment of the exercise device, the minimum weight setting is zero pounds, and the maximum weight setting achievable is 350 pounds. Adjustment of the loading force coupled through to the pivot arm 72 to the lifting arms 18 can be made in one-pound increments or less as desired by the user and as limited by the responsiveness of the electric motor 110 and other components of the exercise device 10. This is to be compared with prior art exercise devices where the weights are adjusted typically as much as 10- to 20-pound increments. As previously noted, the change in loading force can be achieved at any time during an exercise program, even during a single exercise cycle. Further, the changes can be accomplished by the user directly as the exercise program is in progress, or preselected in advance.

Figure 6:
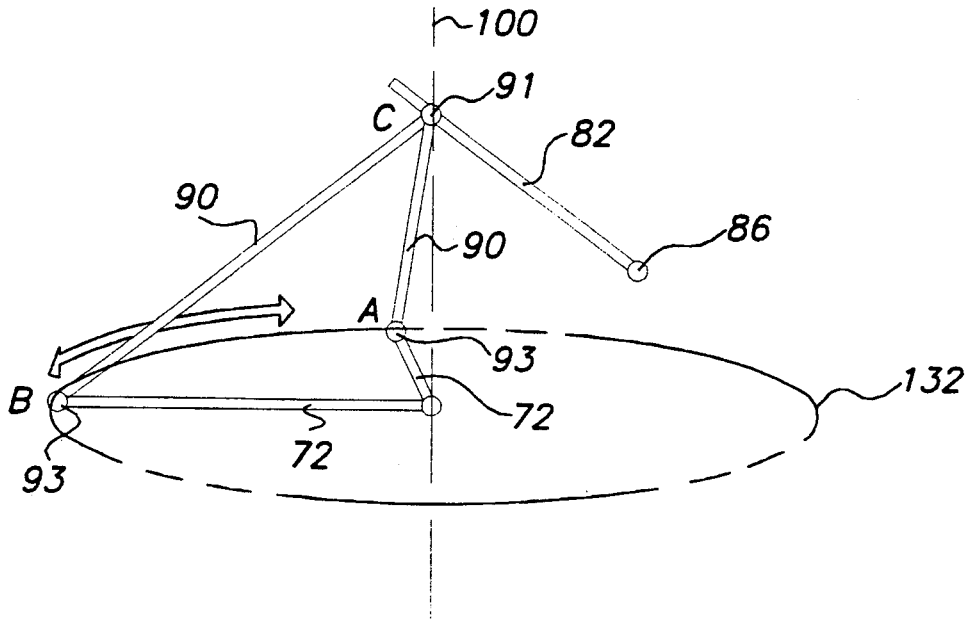
FIG. 6 is a schematic drawing illustrating the operation of the exercise device of FIG. 1 corresponding to the non-loading horizontal pivot arm plane angular orientation of FIG. 2.

FIG. 6 shows a schematic representation of the movement of the pivot arm 72 between a rest position "A" and a second position "B" which occurs when the lifting arms 18 are moved upward by the user when the angular orientation of the pivot arm plane is in the non-loading horizontal orientation. As before, the pivot arm plane is indicated by the reference numeral 132 and is shown as having a circular path. As can be seen, when the pivot arm 72 is moved from position "A" to position "B" with the plane having the non-loading horizontal orientation, the fixed length pivot rod 90, which is connected between the weight-lifting arm 82 and to the pivot arm, does not produce vertical movement of the weight-lifting arm which remains at its rest position "C". As such, no movement of the weight 24 connected to the free end 80 of the weight-lifting arm 82 results.

Figure 7:
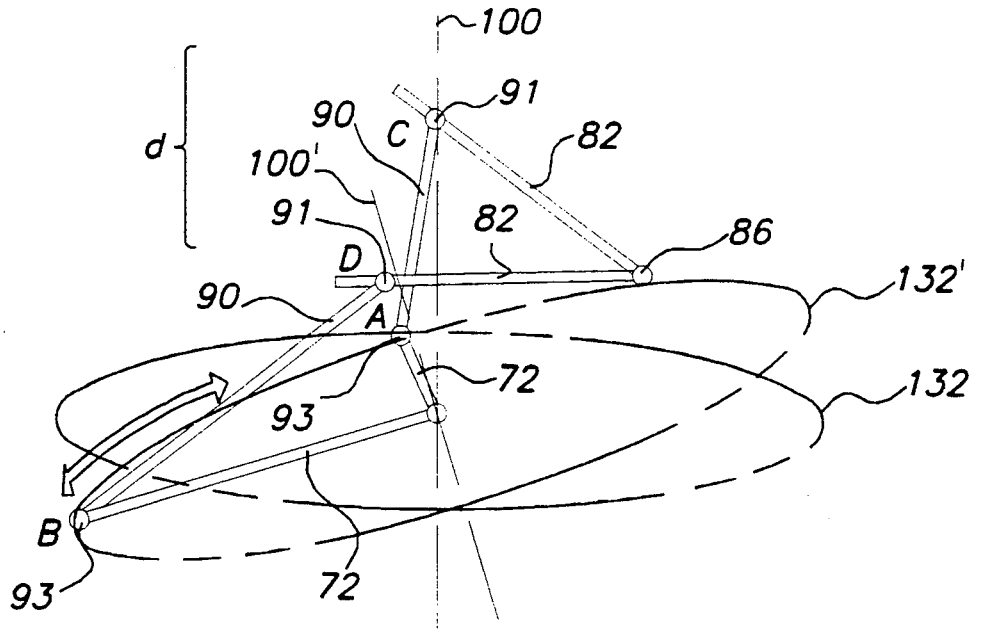
FIG. 7 is a schematic drawing illustrating the operation of the exercise device of FIG. 1 corresponding to the downwardly tilted pivot arm plane angular orientation of FIG. 3.

As illustrated in FIG. 7, when the angular orientation of the pivot arm plane is adjusted to the orientation again indicated by the reference numeral 132', the axis of rotation 100 of the pivot arm 72 is angularly re-oriented to the position shown by reference numeral 100'. This results in downward movement of the upper end of the link rod 90 connected to the weight-lifting arm 82 and pulling of the weight-lifting arm downward from its rest position "C" to a lower position "D" by an amount indicated by the letter "d" as the pivot arm 72 moves from position "A" to position "B". The greater the downward tiling of the pivot arm plane, the greater will be the distance "d" the weight-lifting arm 82 moves.

This results because the link rod 90 is attached to the pivot arm 72 by its lower end and must travel therewith, and has an inextensible length. As such, pivotal downward movement of the weight-lifting arms 82 must occur.

In the illustrated embodiment of FIG. 1, the pivot arm plane can be tilted downward a maximum of about 40° from the non-loading horizontal orientation. This corresponds to a range of loading force that can be coupled through the pivot arm 72 to the lifting arms 18 of from zero to 350 pounds using a weight 24 weighing 600 pounds. It is noted that while the pivot arm plane is illustrated as a circular path, the actual range of rotational movement of the pivot arm 72 about its axis of rotation 100 will be substantially less than 360°. In the illustrated embodiment of FIG. 1, the pivot arm rotates through an arc having a maximum of about 50°.

As described, the illustrated embodiment of the exercise device 10 shown in FIG. 1 utilizes a link member 58. It is to be understood that if a different style or type of coupling member to which the user applies a moving or resisting force is used, the link member 58 may be eliminated and the coupling member connected directly or through some other mechanism to the upper arm 64 of the crank 62. Of course, other mechanical arrangements might be used to transmit the loading force from the pivot arm 72 to the coupling member engaged by the user.

The user controls the angular orientation of the pivot arm plane, either manually during an exercise program or through selecting in advance a pattern for the exercise program, through the control panel 48 mounted next to the seat 12. In such fashion, adjustment of the loading force coupled by the pivot arm 72 to the lifting arms 18 can be achieved without requiring the user to leave the seat 12 and without the user having to manipulate pins or otherwise take action to increase or decrease the number of individual weights that will be moved by the lifting arms. Rather, the adjustment of the loading force on the lifting arms is accomplished simply by electronically controlling the electric motor 110 to change the angular orientation of the pivot arm plane. The weight 24 has a fixed size and no weights need be added or removed, as done with prior weight stacks.

In the preferred embodiment of FIG. 1, the weight 24 weighs 600 pounds. While the size of the weight 24 is not changed during use of the exercise device 10, simply the amount of the loading force coupled between the pivot arms 72 and the lifting arms 18, the weight 24 is constructed of several smaller weights releasably connected together such that, when desired, the weight 24 can be disassembled to facilitate movement and assembly of the exercise device 10. While not illustrated, the weight 24 can be supplemented or replaced by utilizing the weight of the user sitting in the seat 12, in which case the movement of the lifting arms 18 would result in lifting and lowering of the seat with the user therein.

It is noted that by changing the amount of the loading force coupled between the pivot arms 72 and the lifting arms 18, the distance and speed the weight 24 travels during the course of an exercise is varied. At a loading force of 10 pounds, the weight 24 will travel about 1/10th the distance and speed the weight will travel when a 100-pound loading force is selected. Because of the high forces and low speeds, the impulse durations are shorter than with conventional weight lifting equipment. As such, the forces encountered within the components of the exercise device 10 are higher, and the impulse duration required for an equivalent change of momentum is much shorter. This makes the exercise device 10 very responsive to changes in the force applied by the user and avoids the problem of large inertial distortions of the force curve based on acceleration.

Figure 8:
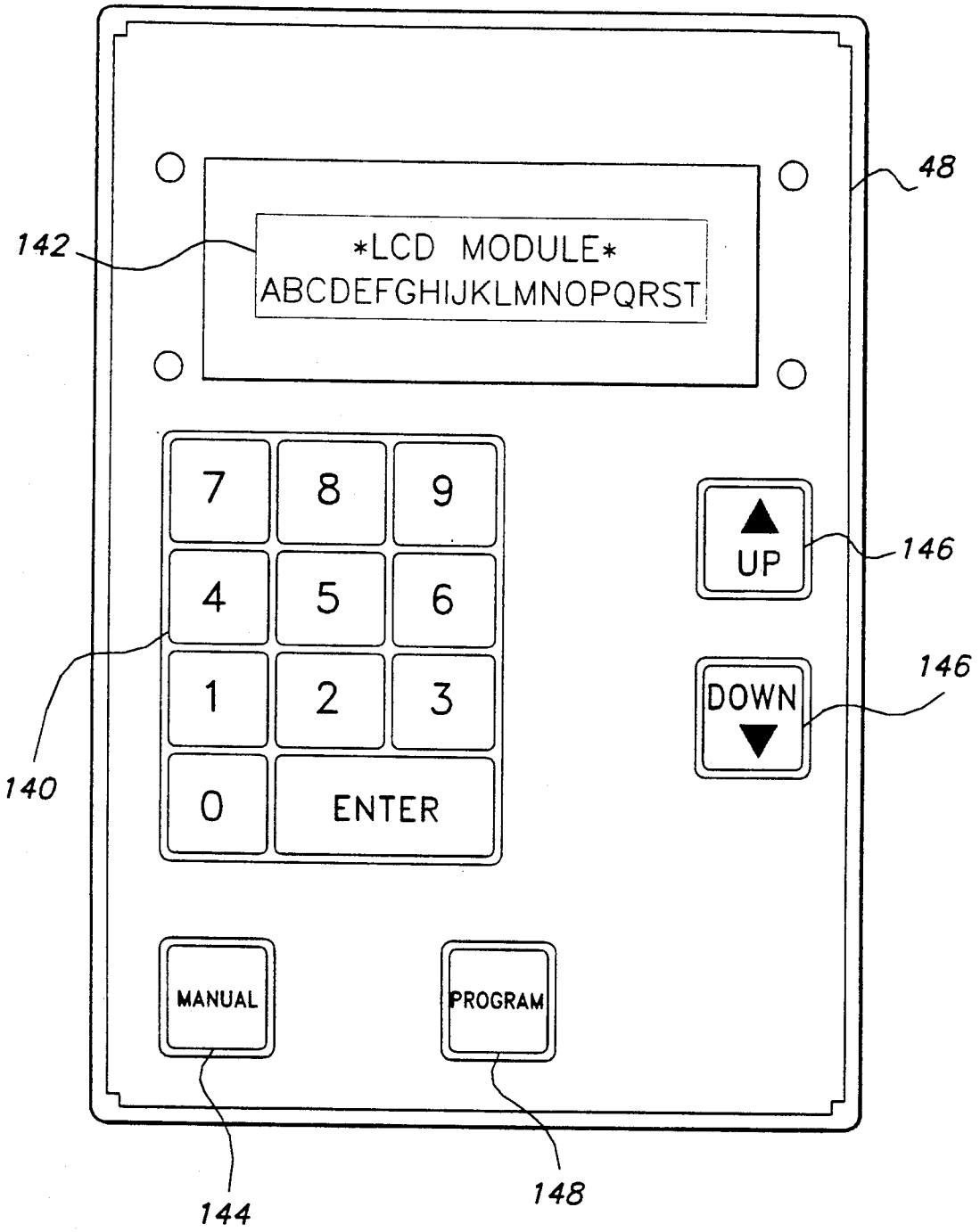
FIG. 8 is an enlarged view of the control panel shown in FIG. 1.

As best shown in FIG. 8, the control panel 48 includes a keypad 140 and a liquid crystal display (LCD) 142 for displaying instructions, performance measurements, control settings and exercise program pattern options. In the simplest form of operation selected by depressing a "manual" button 144, unless already in the manual mode, the keypad 140 is used to select a weight setting to be experienced on the lifting arms 18 during the exercise program until a new weight setting is selected. The exercise device 10 automatically adjusts the pivot arm plane to couple the loading force to the lifting arms that will produce the desired weight setting. The control panel 48 also includes up/down buttons 146 which allow the user to selectively adjust up and down the weight setting desired, rather than entering it via the keypad 140.

A "program" button 148 is provided by which the user can select programmed operation, and then using the keypad 140 select one of several preprogrammed exercise programs. After one of the preprogrammed exercise programs is selected, the keypad 140 is used to select whatever parameters are required for the selected exercise program. For example, it may be necessary for the user to input a starting weight setting, an ending weight setting, and a number of desired exercise cycles (i.e., repetitions). Based on this information, the exercise device 10 will perform the exercise program making appropriate changes to the loading force coupled to the lifting arms during the course of the exercise program. The exercise program selected might be one which continuously increases the weight setting as the exercise program is performed, or continuously decreases the weight setting. Alternatively, the exercise program might progressively increase the loading force coupled to the lifting arms at the end of each concentric motion for a preselected number of exercise cycles.

A "personal trainer" exercise mode might be selected where the preselected program will be performed with the exercise device 10 using intelligence to make decisions about the user's performance and automatically making appropriate adjustments to the loading force during the course of the exercise program. This includes increasing the loading force for the next exercise cycle if a fast concentric motion is detected; lowering the loading force applied during the eccentric motion for the next exercise cycle if a fast eccentric motion is detected; reducing the loading force for the concentric motion for the next exercise cycle if a slow concentric motion is detected; increasing the loading force for the eccentric motion for the next exercise cycle if a slow eccentric motion is detected; and immediately reducing the loading force applied if movement of the lifting arms stops or almost stops during a concentric motion, at least until the motion resumes.

Another exercise program which can be accomplished with the exercise device 10 involves initially coupling a low loading force to the lifting arms 18, and then incrementally in small amounts increases the loading force for each exercise cycle until a failure is sensed. This establishes a maximum loading force. A failure is defined as a very slow concentric motion, or a failure to raise the lifting arms upward beyond a preselected position before commencing an eccentric motion. If the failure is sensed, the loading force is automatically decremented back to the starting loading force while the user continues to perform exercise cycles.

This exercise program has a second part where the loading force coupled to the lifting arms 18 during the concentric motion is set at a preselected percentage of the maximum loading force determined during the first part of the exercise program noted above (such as 75%), and the loading force coupled to the lifting arms during the eccentric motion is set at a preselected percentage of the maximum loading force determined (such as 150%). In other words, a variable loading force is coupled to the lifting arms 18 by the exercise device 10 based upon the previous performance of the user. The exercise program would be set for the user to do a preselected number of exercise cycles with this loading force pattern (such as 10 exercise cycles). Of course, because the loading force is changed between the concentric motion and the eccentric motion for each exercise cycle, the user would be required to pause somewhat between the motions to allow the automatic changing of the loading force.

Yet a third part of the exercise program is to couple a loading force to the lifting arms 18 set at a preselected percentage of the maximum value determined during the first part of the exercise program (such as 50%), and continue the exercise program for a preselected number of exercise cycles (such as 10 or 20 exercise cycles), with the pace being at a relatively high speed.

Using this particular three-part exercise program, it is not necessary f or the user to know or care about the initial weight setting to be used, since the exercise device 10 will determine during the first part of the exercise program the proper weight setting to be used by gradually increasing the loading force until a failure is sensed. Thus, the weight setting is selected based upon the performance of the user during the actual exercise being formed.

Figure 9:
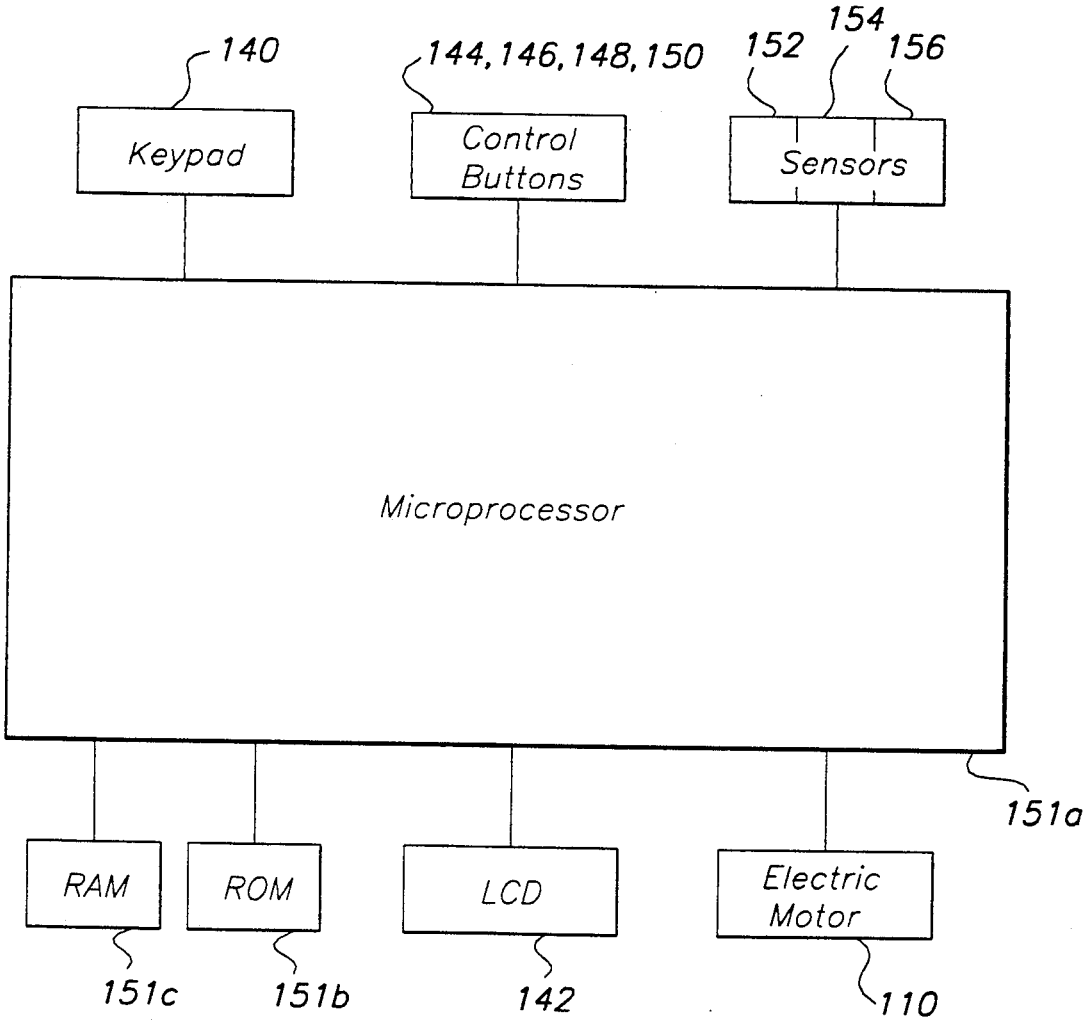
FIG. 9 is a block diagram illustrating the electronic control and display elements used in the exercise device of FIG. 1.

To accomplish the various functions and features of the exercise device 10, a microprocessor 151*a*, a read-only memory (ROM) 151*b*, and a random access memory (RAM) 151*c* are provided, as shown schematically in FIG. 9. These components are mounted on a printed circuit board in the control panel 48. The ROM 151*b* contains system programming which controls operation of the exercise device 10. The programming allows the user to select a desired weight setting for the lifting arms 18 or a pattern of weight settings which may vary over an exercise cycle, or from cycle to cycle, or both, and couples the required loading force to the lifting arms as necessary to produce the desired weight settings. Once the user selects the desired weight setting for the lifting arms, whether using the manual mode or the program mode, the exercise device 10 must determine the value of the angular orientation of the pivot arm plane which will produce the required loading force and then cause the electric motor 110 to operate to rotate the lever arm 106 sufficiently to place the pivot arm support 98 in a rotational position which corresponds to the determined value for the pivot arm plane.

Since the loading force that the pivot arm 72 couples to the lifting arm 18 is dependent upon the angular orientation of the pivot arm plane, such as is illustrated in FIGS. 2 and 3, it is important to know at all times the angular orientation of the pivot arm plane. This is achieved by the use of an initialization sensor 152 attached to the lever arm 106 in a position adjacent the traveler nut 108 which indicates a preestablished initial position for the lever arm, and hence the pivot arm plane. This serves as a reference only. A ramp encoder sensor 154 is located on an inward end of the electric motor 110 to sense the clockwise and counterclockwise rotational movement of the shaft of the electric motor. This serves as an incremental encoder which adds and subtracts the count of shaft rotations so that the changes from the initial reference position sensed by the position sensor 152 can be determined. By tracking the movement of the electric motor 110, which provides the drive to rotate the lever arm 106 from the sensed initial position, the angular orientation of the pivot arm plane is known at all times.

The sensors 152 and 154 work in conjunction with the microprocessor 151*a* to allow the exercise device 10 to determine the position of the pivot arm plane and control the repositioning of the pivot arm plane at all times. To know the exact loading force that will be applied by the pivot arm 72 to the lifting arms 18 for a particular angular orientation of the pivot arm plane, a look-up table stored in the ROM 151*b* is used. A look-up table containing the loading forces that corresponds to particular angular orientations of the pivot arm plane is used because the geometry of the mechanical arrangement of the exercise device 10 does not produce a linear relationship between the pivot arm plane and the loading force, and a look-up table is quicker and less expensive than using a complicated formula to calculate the loading force.

It is also sometimes important to know the position of the lifting arms 18, such as when it is desired to establish the range of motion of the user or to monitor the speed of an exercise. This is accomplished using a sensor 156 mounted on the upper pivot pin 96, which measures the movement of the pivot arm 72 relative thereto. Of course, the rotational position of the pivot arm 72 relative to the pivot pin 96 directly relates to the position of the lifting arms 18. As previously noted, when the lifting arms 18 are in the rest position, the pivot arm is in the positions shown in solid line in FIGS. 2 and 3, and when the lifting arms are raised, the pivot arm is rotated forward, such as to the positions shown in phantom line in FIGS. 2 and 3. The sensor 156 can be used to not only determine the position of the lifting arms at any time, but also in conjunction with the microprocessor 151*a* to calculate the speed of the upward and downward motion of the lifting arms so as to determine the speed of the exercise being performed by the user.

As previously mention, the exercise device 10 includes a microprocessor 151*a* mounted on a circuit board in the control panel 48. The microprocessor 151*a* controls the position of the pivot arm plane based on the information provided by the sensors 152 and 154. When a particular pattern is selected by the user for an exercise program, the microprocessor 151*a* controls the pivot arm plane based upon the position the user moves the lifting arms 18 during the course of an exercise cycle. The microprocessor will also determine if the user raises the lifting arms 18 beyond a preselected end-range position to determine that a concentric motion (i.e., an upward extension) has been completed, or if the user has stopped or almost stopped moving the lifting arms prior to reaching the preselected end-range position. If such a stopped or near-stopped condition occurs prior to the selected end-range position, the microprocessor considers the exercise cycle a failure and will make an appropriate gradual reduction of the loading force the pivot arm 72 applies to the lifting arms 18 so that the user will experience a lesser weight setting almost immediately when finishing the concentric motion and performing the eccentric motion (i.e., the downward return to the rest position). Further, the microprocessor will automatically adjust the pivot arm plane to couple a lower loading force from the pivot arm 72 to the lifting arms 18 for the next exercise cycle or set of cycles.

In the embodiment of FIG. 1, the preselected end-range position is selected at a point which is approximately six inches short of the maximum concentric motion (i.e., upward motion) accomplished by the user during a practice exercise cycle which is used to determine the maximum concentric motion for the user. This value differs for different users since the upward movement of the lifting arms 18 when the user has his or her arms at full upward extension will vary depending on the size of the user and the position to which the seat 12 is elevated.

With the ability to control the loading force applied to the lifting arms 18 during the course of an exercise program, and even during the course of a single exercise cycle of an exercise program, the exercise machine 10 can make decisions about weight-setting adjustments and automatically make the adjustments while the exercise program is in process without the user being required to stop the exercise program or to leave the seat 12 to make the necessary adjustment. For example, if the sensed concentric motion is faster than a preselected speed, the microprocessor 151*a* will automatically change the angular orientation of the pivot arm plane to increase the loading force the pivot arm 72 couples to the lifting arms 18 for the next exercise cycle. On the other hand, if the eccentric motion is too fast, the loading force will be decreased for the next exercise cycle. Also, if the eccentric motion is slower than a preselected speed, which results when the user is stopping the downward motion of the lifting arms too often or for too long a period, the microprocessor will adjust the pivot arm plane to increase the loading force for the next exercise cycle since it is assumed that the user is able to resist an even greater loading force.

With the use of a microprocessor 151*a* and feedback provided by the sensors 152, 154 and 156, it is possible to provide a pacer function which displays on the LCD 142 and provides an audio tone to pace the user when performing concentric and eccentric motions. Further, the microprocessor can respond to a user-preselected exercise program, and present preexisting standard exercise programs for the user to select. Further, the microprocessor will allow the user to select from a variety of workout levels.

The design of the exercise device 10 allows change in the loading force coupled through to the lifting arms 18 when in the middle of an exercise cycle to be made in a safe manner. The weight 24 cannot be suddenly released or the loading force suddenly changed so that the moving or resistance force being applied by the user to the lifting arms 18 produces a sudden and unexpected large movement of the lifting arms which could result in injury to the user.

Another advantage of the exercise device 10 is that its overall size is smaller than equivalent prior art weight lifting devices that provide the same overall range of weight loading.

Figure 10:
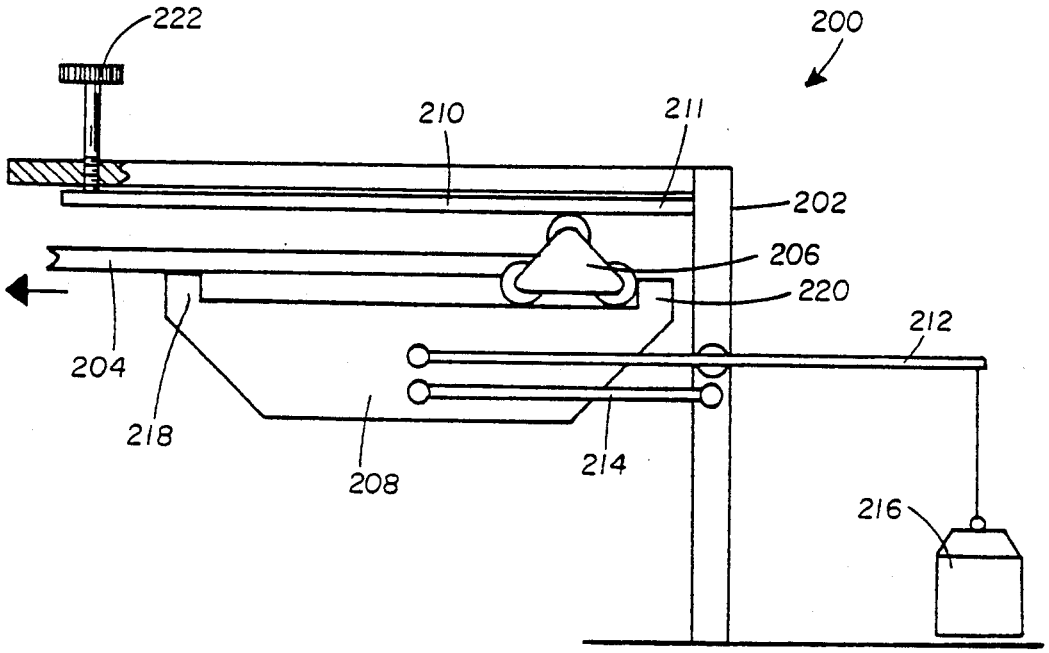
FIG. 10 is a schematic drawing of an alternative embodiment of the exercise device of FIG. 1 showing a non-loading horizontal guide ramp angular orientation with the device having a traveler in a rest position.

A second alternative embodiment of an exercise device 200 incorporating the invention is shown schematically in FIGS. 10 through 13. While this second alternative embodiment differs in construction, the principles involved are substantially the same as described above f or the exercise device 10. Reference is made to FIG. 10 which shows the exercise device 200 having a floor-engaging support frame 202. Exercise is achieved by the user applying a force which is transmitted to an input arm 204 to move the input arm horizontally forward and backward. The input arm 204 has at a free end thereof a three-wheeled traveler 206 positioned with two lower wheels engaging a platform 208, and an upper wheel engaging a guide ramp 210.

The guide ramp 210 is pivotally connected to the support frame 202 at its end 211. The platform 208 is connected to the support frame 202 through a pair of parallel upper and lower pivot arms 212 and 214, respectively. One end of each of the pivot arms 212 and 214 is pivotally connected to the platform 208. The upper pivot arm 212 is pivotally connected at a mid-portion thereof to the support frame 202. The one end of the lower pivot arm 214 is also pivotally connected to the support frame 202. The upper pivot arm 212 has a longer length than the lower pivot arm 214 and has a free end which extends out beyond the point of pivotal connection to the support frame 202. A fixed size weight 216 is suspended from the free end of the upper pivot arm 212 at a position above the ground. As will be readily understood, the weight 216 applies a downward force on the upper pivot arm 212, which is transmitted back through to the platform 208 which applies an upward force on the traveler 206 to keep it in engagement with the guide ramp 210.

The input arm 204 is connected to a coupling member (not shown) which the user engages and moves to cause reciprocating horizontal movement of the input arm 204 between a pair of end stops 218 and 220 of the platform 208. As can be readily understood, when the guide ramp 210 is in the horizontal position of FIGS. 10 and 11, as the input arm 204 moves the traveler 206 back and forth between the end stops 218 and 220, no upward or downward pivotal movement of the platform 208 occurs. In this position, the weight 216 transfers no horizontal loading force to the input arm 204.

Figure 11:
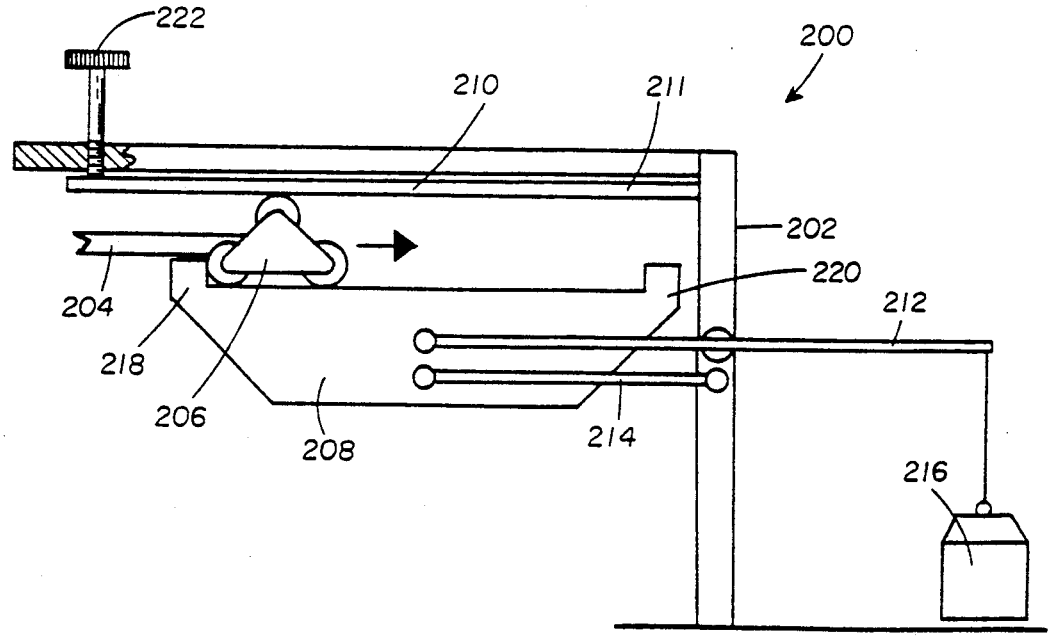
FIG. 11 is a schematic drawing of the exercise device of FIG. 10 again in the non-loading horizontal guide ramp angular orientation but with the traveler in a moved position.

The traveler 206 is shown in FIG. 10 adjacent to the end stop 220 in preparation for movement toward the end stop 218. In FIG. 11, the traveler 206 is shown moved to a position adjacent the end stop 218, in preparation for return movement toward the end stop 220. The movement of the traveler 206 toward the end stop 218 corresponds to a concentric motion of an exercise cycle. The return movement of the traveler 206 toward the end stop 220 represents eccentric motion of an exercise cycle.

Of course, the reciprocal movement of the input arm 204 to move the traveler 206 back and forth between the end stops 218 and 220 when the guide ramp 210 is in the horizontal position produces no exercise except for that needed to overcome the inherent weight and friction of the coupling member and whatever other components are involved. No loading force is supplied by the weight 216. However, the guide ramp 210 can be selectively angularly adjustable to gradually couple the weight of the weight 216 to the input arm 204, as is illustrated in FIGS. 12 and 13.

Figure 12:
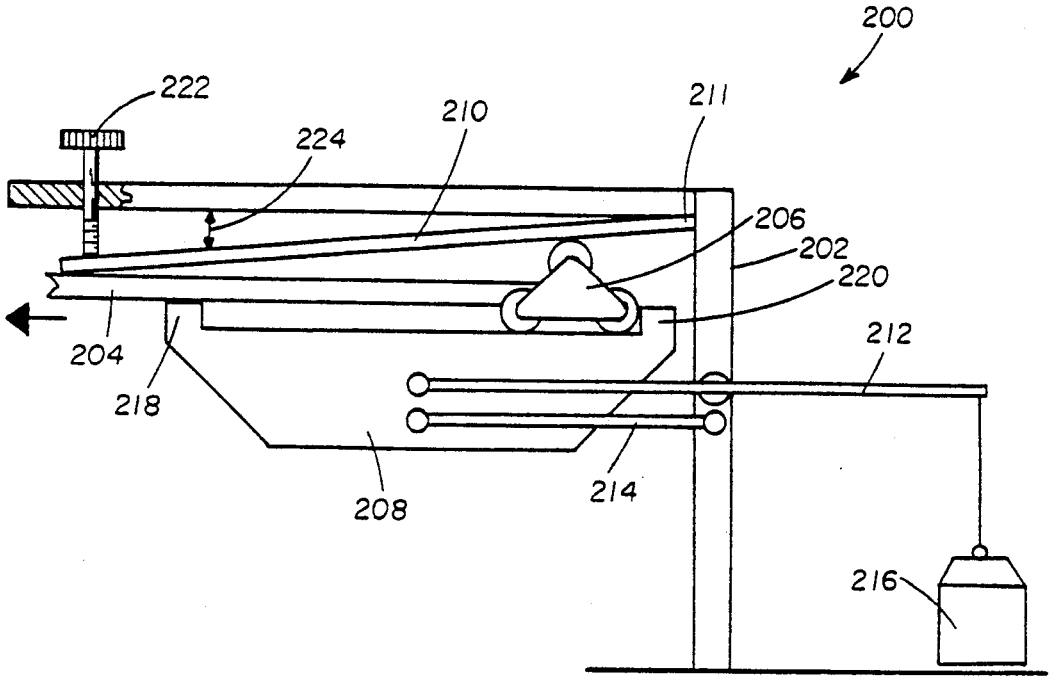
FIG. 12 is a schematic drawing of the exercise device of FIG. 10 showing the guide ramp adjusted to a downwardly tilted angular orientation with the traveler in the rest position.
Figure 13:
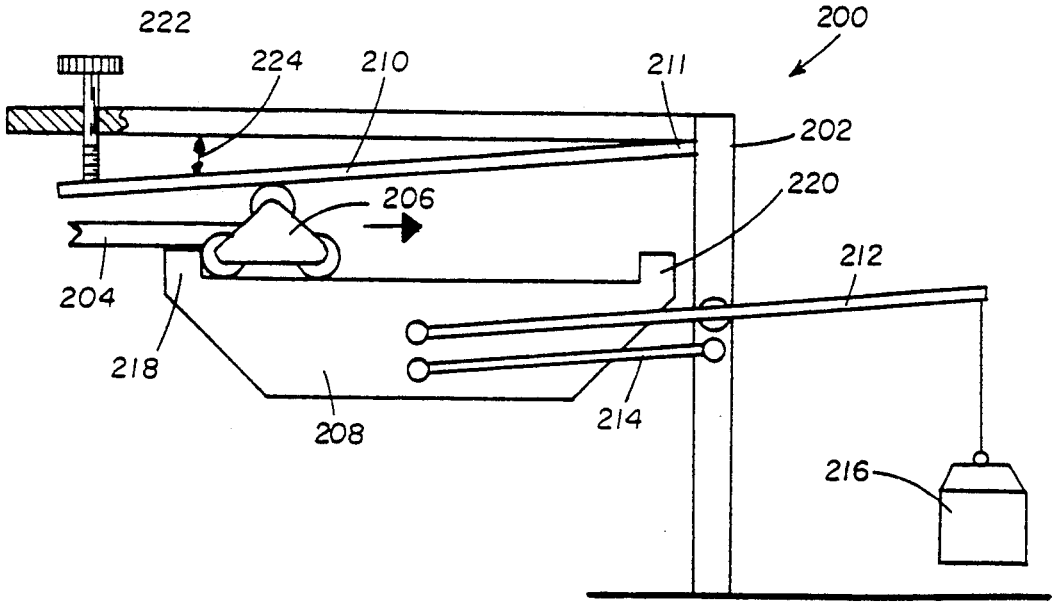
FIG. 13 is a schematic drawing of the exercise device of FIG. 10 again in the downwardly tilted guide ramp angular orientation but with the traveler in the moved position.

This is accomplished by moving a ramp adjustment member 222 downward to rotate the guide ramp 210 downward by a desired angular displacement (indicated by the double-headed arrow 224 in FIGS. 12 and 13). The ramp adjusting member 222 has one end in engagement with the guide ramp 210, and downward movement of the adjustment member 222 produces a corresponding downward angular adjustment of the guide ramp 210. It will be readily understood that with the adjustment member 222 holding the guide ramp 210 in the angular orientation shown in FIGS. 12 and 13, when the traveler 206 is at the end stop 220, which corresponds to a rest position, and the user applies a concentric motion to the exercise device 200 which is translated to a leftward force on the input arm 204, the weight 216 must be lifted to move the traveler along the inclined guide ramp. As the traveler 206 moves from the end stop 220 toward the end stop 218, the downward slope of the guide ramp 210 causes the platform 208 to move downward with the maximum displacement occurring when the traveler reaches the end stop 218. The eccentric motion corresponds to return of the traveler 206 from adjacent the end stop 218 to the end stop 220. During this travel, the user must apply a resisting force to the input arm 204 to resist the return movement of the traveler 206 toward the end stop 220. The larger the angular incline of the guide ramp 210 below the horizontal, the larger the loading force which is coupled by the weight 216 to the input arm 204.

Much as with the exercise device 10 described above, the amount of force supplied by the weight 216 which is coupled to the input arm 204 varies as a function of the tangent of the angular displacement of the guide ramp 210 below the non-loading horizontal orientation shown in FIGS. 10 and 11. The guide ramp 210 limits movement of the traveler 206 to a plane whose angular orientation is selectively adjustable using the adjustment member 222, much as the pivot arm plane can be angularly adjusted in the exercise device 10 described above. It is noted that while the guide ramp 210 is illustrated as being straight to produce linear coupling of the force supplied by the weight 210 to the input arm 204, the guide ramp may also be constructed with all or a portion of the guide ramp curved if desired. Thus, the path of the traveler 206 along the guide ramp need not be planar.

As with the exercise device 10, the guide ramp 210 is angularly adjustable to infinitely variable angular orientations (i.e., ramp angles). Also, the angular orientation of the guide ramp 210 can be changed as the traveler is moving along the guide ramp. It should be understood that while the exercise device 200 is illustrated using a guide ramp 210 and a wheeled traveler 206, the guide ramp could be replaced with other types of guides, such as a pivotal arm having a longitudinal guide slot formed therein with either a straight path or a curved path, and the traveler replaced with a follower pin which projects through and is guided by the guide slot as the input arm 204 back and forth between the end stops 218 and 220.

In both the exercise device 10 and the exercise device 200, a conversion member transmits a selectable force between a member that couples the user to the device and a fixed size weight, with the conversion member being restrained to move along a prescribed path having a selectable angular orientation. The angular orientation of the conversion member path is selectively adjustable, with adjustment of the conversion member angular orientation selectively changing the amount of the force supplied by the weight which is coupled to the coupling member.

It will be appreciated that, although specific embodiments of the invention have been described herein for purposes of illustration, various modifications may be made without departing from the spirit and scope of the invention. Accordingly, the invention is not limited except as by the appended claims.

We claim:

1. An exercise device for a human user, comprising:

a first member movable by the user between a rest position and an end limit of travel position, the user achieving exercise by the application of a moving force thereto to move said first member from said rest position to a desired position toward said end-limit position, and by the application of a resisting force thereto to resist return movement of said first member from said desired position toward said rest position;

a constant weight movable between a lowered position to an elevated position which corresponds to said rest and end-limit positions of said first ember, respectively;

a second member operatively connected to said weight and movable within a second member plane between a first position and a second position to move said weight between said lowered position and said elevated position;

a conversion member operatively engaging said first and second members to transmit a selectable force between said first member and said weight as said conversion member moves along a prescribed path within a conversion member plane having a selectable angular orientation, said conversion member being restrained to move along said path within said conversion member plane, said angular orientation of said conversion member plane being selectively adjustable to a plurality of angular orientations between first and second end limit of adjustment angular orientations, said second and conversion members being arranged such that adjustment of said conversion member plane angular orientation to selected angular orientations between said first and second orientations selectively changes the amount of said selectable force coupled by said conversion member between said first member and said weight connected to said second member, adjustment of said conversion member plane angular orientation from said first orientation toward said second orientation selectively increasing said selectable force coupled by said conversion member between said first member and said weight, and adjustment of said conversion member plane angular orientation from said second orientation toward said first orientation selectively decreasing said selectable force coupled by said conversion member between said first member and said weight, thereby the user moving force required to move said first member from said rest position toward said desired position and the user resisting force required to resist return movement of said first member from said desired position toward said rest position can be selectively increased or decreased by adjusting said conversion member plane angular orientation; and an adjustable member operable to selectively adjust said conversion member plane angular orientation between said first and second angular orientations.

2. The device of claim 1, wherein said adjustable member is a ramp angularly adjustable between first and second ramp angles, and said conversion member is a traveler which moves along said ramp with said conversion member plane within which said traveler moves being angularly adjusted by changing the angle of said ramp relative to said first ramp angle, said traveler coupling more force between said first member and said weight as the angle of said ramp is changed relative to said first ramp angle.

3. The device of claim 1, wherein said conversion member is a pivot arm pivotally connected to a pivot arm support to pivot about an axis of rotation, and said conversion member plane is a plane through which said pivot arm moves as it pivots about said pivot arm axis, and wherein said adjustable member is coupled to said pivot arm support and selectively moves said pivot arm support to angularly move said pivot arm axis and thereby selectively adjust said conversion member plane angular orientation.

4. The device of claim 1, wherein said conversion member is a pivot arm which has a first end portion pivotally connected by a pivot arm pivot connection to a pivot arm support for pivotal movement of said pivot arm within said conversion member plane along said prescribed path about a pivot arm axis of rotation, and a free, second end portion, and said second member is a lifting arm which is pivotally connected by a lifting arm pivot connection to a lifting arm support for pivotal movement of said lifting arm within said second member plane, the device further including a fixed length link arm attached at one end to said second end portion of said pivot member and at an opposite end to said lifting arm at a position therealong a distance from said, lifting arm pivot connection, and wherein said adjustable member is coupled to said pivot arm support and selectively moves said pivot arm support to angularly rotate said conversion member plane between said first and second orientations and hence said pivot arm axis of rotation relative to said second member plane, said pivot arm transmitting force between said first member and said lifting arm as a function of the angle between said conversion member plane-and said second member plane.

5. The device of claim 4, wherein said conversion member plane is movable into a non-loading orientation substantially perpendicular to said second member plane where movement of said pivot arm transmits substantially zero force between said first member and said lifting arm.

6. The device of claim 5, wherein said conversion member plane, when in said second orientation, is oblique to said second member plane such that movement of said pivot arm transmits a maximum force between said first member and said lifting arm.

7. The device of claim 6, wherein said pivot arm transmits a force with a magnitude between said zero and maximum force between said first member and said lifting arm dependent on the angular position of said conversion member plane between said non-loading and second orientations.

8. The device of claim 6, wherein said conversion member plane, when in said first orientation, is oblique to said second member plane, with an angular orientation to a side of said non-loading orientation opposite said second orientation, such that movement of said pivot arm transmits a force between said first member and said lifting arm which at least partially offsets the magnitude of said moving force required by the user to move said first member to less than the force required when said conversion member plane is in said non-loading orientation.

9. The device of claim 5, wherein said pivot arm axis of rotation, when said conversion member plane is in said non-loading orientation, passes substantially through said position whereat said link member is attached to said lifting arm, whereby when said conversion member plane is in said non-loading orientation substantially perpendicular to said second member plane, said pivot arm can freely pivot about said pivot arm axis of rotation while transmitting substantially no force to said first member.

10. The device of claim 5, wherein said conversion member plane, when in said non-loading orientation, is substantially parallel to an axis of rotation of said lifting arm about said lifting arm pivot connection.

11. The device of claim 4, wherein said pivot arm support is pivotally connected by a support pivot connection to a supporting frame member for movement of said conversion member plane between said first and second orientations, and said adjustable member selectively rotates said pivot arm support about said support pivot connection to selectively adjust said conversion member plane angular orientation.

12. The device of claim 11, wherein said adjustable member includes an adjustment arm coupled at a first end to said pivot arm support and coupled at an opposite second end to an actuator which is selectively operable to move said adjustment arm second end to produce a rational force on said pivot arm support to selectively rotate said pivot arm support about said support pivot connection.

13. The device of claim 12, wherein said actuator includes a selectively rotatable screw and a traveler nut mount thereon, said adjustment arm second end being coupled to said traveler nut f or travel therewith along said screw and thereby produce a force on said adjustment arm which provides said rotational force to said pivot arm support to selectively rotate said pivot arm support about said support pivot connection.

14. The device of claim 13, wherein said actuator includes an electric motor which selectively provides rotational drive to said screw.

15. The device of claim 1, wherein said adjustable member is operable to adjust said conversion member plane angular orientation when said first member is in a position other than said rest position to selectively vary said selectable force without having first to move said first member to said rest position.

16. The device of claim 1, wherein said adjustable member is operable to adjust said conversion member plane angular orientation while said first member is moving between said rest and end-limit positions to selectively vary said selectable force.

17. The device of claim 1, wherein said conversion member plane is angularly adjustable to infinitely variable angular orientations between said first and second orientations in response to operation of said adjustable member.

18. The device of claim 1 further including a programmable controller which controls operation of said adjustable member according to a user-selected exercise program including a preselected pattern for said selectable force to be transmitted by said conversion member, said controller including a user-operated input by which the user can enter said program and an actuator operated in accordance with said program to control said adjustable member to adjust said conversion member plane angular orientation to produce said preselected pattern for said selectable force.

19. The device of claim 1 further including a controller which controls operation of said adjustable member according to a user-selected value corresponding to said selectable force, said controller including a user-operated input by which the user can select said selected value, control means for determining the value of said conversion member plane angular orientation which will produce said selectable force corresponding to said selected value, and an actuator responsive to said control means to control said adjustable member to adjust said conversion member plane angular orientation to an angular orientation which produces said selectable force corresponding to said selected value.

20. The device of claim 1 wherein said second member is a lifting arm supported for pivotal movement through said second member plane between said first and second positions in response to movement of said conversion member along said path within said conversion member plane, said lifting arm having a free end portion connected to said weight to lift said weight toward said elevated position as said lifting arm pivotally moves in one pivotal direction in response to said conversion member moving along said path in one path direction and to lower said weight toward said lowered position as said lifting arm pivotally moves in an opposite pivotal direction in response to said conversion member moving along said path in an opposite path direction.

21. The device of claim 1 wherein said first member and said conversion member are connected together through a first interconnecting member so that said conversion member moves along said path within said conversion member plane in a first path direction as said first member moves toward said end-limit position and in a second path direction as said first member moves toward said rest position; and wherein said second member and said conversion member are connected together through a second interconnecting member so that said second member moves within said second member plane toward said second position to lift said weight toward said elevated position as said conversion member moves in said first path direction and toward said first position to lower said weight toward said lowered position as said conversion member moves in said second path direction.

22. An exercise device for a human user, comprising:

a first member movable by the user between a rest position and an end limit of travel position, the user achieving exercise by the application of a moving force thereto to move said first member from said rest position to a desired position toward said end-limit position, and by the application of a resisting force thereto to resist return movement of said first member from said desired position toward said rest position;

a constant weight movable between a lowered position and an elevated position which corresponds to said rest and end-limit positions of said first member, respectively;

a second member operatively connected to said weight and movable between a first position and a second position to move said weight between said lowered position and said elevated position;

a pivot arm operatively connected to said first member and pivotally movable through a pivot arm plane having a user selectable angular orientation to transmit a selectable force between said first member and said weight, said selectable force transmitted between said first member and said weight being dependent upon the angular orientation selected for said pivot arm plane;

a link member connected between said pivot arm and said second member to transmit force therebetween to move said second member form said first position to a travel position toward said second position as said pivot arm moves through said pivot arm plane in a first direction in response to said first member moving from said rest position to said desired position and thereby lift said weight toward said elevated position, and to move said pivot arm through said pivot arm plane in a second direction opposite said first direction in response to said second member moving from said travel position toward said first position as said weight returns from said position to which moved to said lowered position and thereby move said first member from said desired position to said rest position; and an adjustable member operable to select a desired angular orientation for said pivot arm plane, adjustment of said pivot arm plane angular orientation selectively increasing or decreasing said selectable force, thereby the user moving force required to move said first ember from said rest position toward said desired position and the user resisting force required to resist return movement of said first member form said desired position toward said rest position can be selectively increased or decreased by adjusting said adjustable member without changing the amount of said weight.

23. The device of claim 22, further including a pivot arm support to which said pivot arm is pivotally mounted for pivotal movement through said pivot arm plane, said adjustable member selectively rotating said pivot arm support to selectively change the angular orientation of said pivot arm plane.

24. The device of claim 22, wherein said first member includes an interconnecting member through which said pivot arm is connected to said first member to transmit said selectable force between said first member and said pivot arm.

25. The device of claim 24, wherein said link member transmits a continuous loading force produced by said weight to said pivot arm, and said pivot arm transmits a portion of said continuous force comprising said selectable force to said first member through said interconnecting member.

26. The device of claim 22, wherein said pivot arm plane is movable into a non-loading orientation where movement of said pivot arm transmits substantially zero force between said first member and said second member.

27. The device of claim 26, wherein said pivot arm has a first end portion pivotal connected by a pivot arm pivot connection to a pivot arm support for pivotal movement of said pivot arm within said pivot arm plane about a pivot arm axis of rotation, said pivot arm plane, when in a maximum-loading orientation, is oblique to the orientation of said pivot arm axis of rotation when said pivot arm plane is in said non-loading orientation, such that movement of said pivot arm transmits a maximum force between said first member and said second member.

28. The device of claim 26, wherein said pivot arm has a first end portion pivotally connected by a pivot arm pivot connection to a pivot arm support for pivotal movement of said pivot arm within said pivot arm plane about a pivot arm axis of rotation, said pivot arm plane, when in a negative-loading orientation, is oblique to the orientation of said pivot arm axis when said pivot arm plane is in said non-loading orientation, with an angular orientation to a side of said non-loading orientation, such that movement of said pivot arm transmits a force between said first member and said second member which at least partially offsets the magnitude of said moving force required by the user to move said first member to less than the force required when said pivot arm plane is in said non-loading orientation.

29. The device of claim 26 further including a link member attached at one end to said pivot arm and at an opposite end to said second member, said pivot arm axis of rotation, when said pivot arm plane is in said non-loading orientation, passes substantially through said position whereat said link member is attached to said second member, such that when said pivot arm plane is in said non-loading orientation, said pivot arm can freely pivot about said pivot arm axis of rotation while transmitting substantially no force to said first member.

30. The device of claim 26, wherein said pivot arm has a first end portion pivot connected by a pivot arm pivot connection to a pivot arm support for pivotal movement of said pivot arm within said pivot arm plane about a pivot arm axis of rotation, said adjustable member being coupled to said pivot arm support and selectively moving said pivot arm support to angularly rotate said pivot arm plane and hence said pivot arm axis of rotation, said pivot arm support being pivotally connected by a support pivot connection to a supporting frame member for angular rotation of said pivot arm plane, said adjustable member selectively rotating said pivot arm support about said support pivot connection to selectively adjust said pivot arm plane angular orientation.

31. The device of claim 30, wherein said adjustable member includes an adjustment arm coupled at a first end to said pivot arm support and coupled at an opposite second end to an actuator which is selectively operable to move said adjustment arm second end to produce a rational force on said pivot arm support to selectively rotate said pivot arm support about said support pivot connection.

32. The device of claim 22, wherein said adjustable member is operable to adjust said pivot arm plane angular orientation when said first member is in a position other than said rest position to selectively vary said selectable force without having first to move said first member to said rest position.

33. The device of claim 22, wherein said adjustable member is operable to adjust said pivot arm plane angular orientation while said first member is moving between said rest and end-limit positions to selectively vary said selectable force.

34. The device of claim 22, wherein said pivot arm plane is angularly adjustable to infinitely variable angular orientations between first and second end limit of adjustment angular orientations in response to operation of said adjustable member.

35. The device of claim 22 further including a programmable controller which controls operation of said adjustable member according to a user-selected exercise program including a preselected pattern for said selectable force to be transmitted by said pivot arm, said controller including a user-operated input by which the user can enter said program and an actuator operated in accordance with said program to control said adjustable member to adjust said pivot arm plane angular orientation to produce said preselected pattern for said selectable force.

36. The device of claim 22 further including a controller which controls operation of said adjustable member according to a user-selected value corresponding to said selectable force, said controller including a user-operated input by which the user can select said selected value, control means for determining the value of said pivot arm plane angular orientation which will produce said selectable force corresponding to said selected value, and an actuator responsive to said control means to control said adjustable member to adjust said pivot arm plane angular orientation to an angular orientation which produces said selectable force corresponding to said selected value.

37. The device of claim 22 wherein said second member is a lifting arm supported for pivotal movement between said first and second positions in response to movement of said pivot arm through said pivot arm plane, said lifting arm having a free end portion connected to said weight to lift said weight toward said elevated position as said lifting arm pivotally moves in one pivotal direction in response to said pivot arm moving through said pivot arm plane in one direction and to lower said weight toward said lowered position as said lifting arm pivotally moves in an opposite pivotal direction in response to said pivot arm moving through said pivot arm plane in an opposite direction.

38. The device of claim 22 wherein said first member and said pivot arm are connected together through a first interconnecting member so that said pivot arm moves through said pivot arm plane in a first direction as said first member moves toward said end-limit position and in a second path direction as said first member moves toward said rest position; and wherein said second member and said pivot arm are connected together through a second interconnecting member so that said second member moves toward said second position to lift said weight toward said elevated position as said pivot arm moves through said pivot arm plane in said first direction and toward said first position to lower said weight toward said lowered position as said pivot arm moves through said pivot arm plane in said second direction.

39. An exercise device for a human user, comprising:

a first member movable by the user between a rest position and an end limit of travel position, the user achieving exercise by the application of a moving force thereto to move said first member from said rest position to a desired position toward said end-limit position, and by the application of a resisting force thereto to resist return movement of said first member from said desired position toward said rest position;

a resistance member providing a resistance member force which resists movement of said first member from said rest position to said desired position when the user is applying said moving force, and which moves said first member from said desired position to said rest position when the user is applying said resisting force;

a conversion member operatively engaging said first member and said resistance member to transmit a selected portion of said resistance member force therebetween as said conversion member moves along a prescribed path having a selectable angular orientation, said conversion member being restrained to move along said path, said angular orientation of said conversion member path being selectively adjustable between first and second end limit of adjustment angular orientations, with adjustment of said conversion member path angular orientation between said first and second orientations selectively changing the amount of said selected portion of said resistance member force transmitted by said conversion member between said first member and said resistance member, adjustment of said conversion member path angular orientation selectively orientation toward said second orientation selectively increasing said selected portion of said resistance member force transmitted by said conversion member between said first member and said resistance member, and adjustment of said conversion member path angular orientation from said second orientation toward said first orientation selectively decreasing said selected portion of said resistance member force transmitted by said conversion member between said first member and said resistance member, thereby the user moving force required to move said first member from said rest position toward said desired position and the user resisting force required to resist return movement of said first member from said desired position toward said rest position can be selectively increased or decreased by adjusting said conversion member path angular orientation; and an adjustable member operable to selectively adjust said conversion member path angular orientation between said first and second angular orientations.

40. The device of claim 39, wherein said adjustable member is an angularly adjustable guide movable between first and second guide angles, and said conversion member is a traveler which moves along said guide with said conversion member path along which said traveler moves being angularly adjusted by changing the angle of said guide relative to said first guide angle, said traveler transmitting more of said resistance member force between said first member and said resistance member as the angle of said guide is changed relative to said first guide angle.

41. The device of claim 39, wherein said conversion member is a pivot arm pivotally connected to a pivot arm support to pivot about an axis of rotation, and said conversion member path is a plane through which said pivot arm moves as it pivots about said pivot arm axis, and wherein said adjustable member is coupled to said pivot arm support and selectively moves said pivot arm support to angularly move said pivot arm axis and thereby selectively adjust said conversion member path angular orientation.

42. The device of claim 39, wherein said conversion member path has at least a substantially linear portion.

43. An exercise device for a human user, comprising:

a first member movable by the user between an initial position and a displaced position, the user achieving exercise by the application of a moving force thereto to move said first member from said initial position to said displaced position, and by the application of a resisting force thereto to resist return movement of said first member from said displaced position toward said initial position;

a resistance member providing a resistance member force which resists movement of said first member from said initial position to said displaced position when the user is applying said moving force, and which moves said first member from said displaced position toward said initial position when the user is applying said resisting force;

a conversion member coupling a selectable portion of said resistance member force between said first member and said resistance member as said conversion member moves along a prescribed path having a selectable angular orientation, said conversion member being restrained to move along said path, said angular orientation of said conversion member path being selectively adjustable to a plurality of angular orientations between first and second end limits of adjustment angular orientations, said conversion member selectively changing the amount of said selectable portion of said resistance member force coupled between said first member and said resistance member in proportion to the angular orientation selected for said conversion member path angular orientation, whereby the user moving force required to move said first member from said initial position to said displaced position, and the user resisting force required to resist return movement of said first member from said displaced position toward said initial position can be selectively increased or decreased by adjusting said conversion member path angular orientation; and an adjustment member operable to selectively adjust said conversion member path angular orientation between said first and second angular orientations.

44. The device of claim 43, wherein said resistance member is a constant weight movable between a lowered position and an elevated position.

45. The device of claim 43, wherein said conversion member path has at least a substantially linear position.

46. The device of claim 43, wherein said adjustment member includes an angularly adjustable guide which limits movement of said conversion member and thereby defines said conversion member plane.

47. The device of claim 43, wherein said conversion member is a pivot arm connected to pivot about an axis of rotation, and said conversion member path is a path through which said pivot arm pivots about said pivot arm axis, and wherein said adjustment member selectively angularly moves said pivot arm axis to selectively adjust said conversion member path angular orientation.

48. The device of claim 43, wherein said conversion member path is movable into a non-loading orientation where movement of said conversion member transmits substantially zero force between said first member and said resistance member.

49. The device of claim 48, wherein said conversion member is a pivot arm which has a first end portion pivotally connected by a pivot arm pivot connection to a pivot arm support for pivotal movement of said pivot arm within said conversion member plane about a pivot arm axis of rotation, said conversion member plane, when in a maximum-loading orientation, is oblique to the orientation of said pivot arm axis of rotation when said pivot arm conversion member plane is in said non-loading orientation, such that movement of said pivot arm transmits a maximum force between said first member and said resistance member.

50. The device of claim 48, wherein said conversion member is a pivot arm which has a first end portion pivotally connected by a pivot arm pivot connection to a pivot arm support for pivotal movement of said pivot arm within said conversion member plane about a pivot arm axis of rotation, said conversion member plane, when in a negative-loading orientation, is oblique to the orientation of said pivot arm axis of rotation when said conversion member plane is in said non-loading orientation, with an angular orientation to a side of said non-loading orientation, such that movement of said pivot arm transmits a force between said first member and said resistance member which at least partially offsets the magnitude of said moving force required by the user to move said first member to less than the force required when said conversion member plane is in said non-loading orientation.

51. The device of claim 48 further including a link member attached at one end to said pivot arm and at an opposite end to a second member to transmit force therebetween, said second member being operatively connected to said resistance member, said pivot arm axis of rotation, when said pivot arm plane is in said non-loading orientation, passes substantially through said position whereat said link member is attached to said second member, such that when said pivot arm plane is in said non-loading orientation, said pivot arm can freely pivot about said pivot arm axis of rotation while transmitting substantially no force to said first member.

52. The device of claim 48, wherein said conversion member is a pivot arm which has a first end portion pivotally connected by a pivot arm pivot connection to a pivot arm support for pivotal movement of said pivot arm within said conversion member plane about a pivot arm axis of rotation, said adjustment member being coupled to said pivot arm support and selectively moving said pivot arm support to angularly rotate said conversion member plane and hence said pivot arm axis of rotation, said pivot arm support being pivotally connected by a support pivot connection to a supporting frame member for angular rotation of said conversion member plane, said adjustable member selectively rotating said pivot arm support about said support pivot connection to selectively adjust said conversion member plane angular orientation.

53. The device of claim 52, wherein said adjustment member includes an adjustment arm at a first end to said pivot arm support and coupled at an opposite second end to an actuator which is selectively operable to move said adjustment arm second end to produce a rational force on said pivot arm support to selectively rotate said pivot arm support about said support pivot connection.

54. The device of claim 43, wherein said adjustment member is operable to adjust said conversion member plane angular orientation when said first member is in a position other than said rest position to selectively vary said selectable force without having first to move said first member to said rest position.

55. The device of claim 43, wherein said adjustable member is operable to adjust said conversion member plane angular orientation while said first member is moving between said rest and end-limit positions to selectively vary said selectable force.

56. The device of claim 43, wherein said conversion member plane is angularly adjustable to infinitely variable angular orientations between first and second end limit of adjustment angular orientations in response to operation of said ad le member.

57. The device of claim 43 further including a programmable controller which controls operation of said adjustable member according to a user-selected exercise program including a preselected pattern for said selectable force to be transmitted by said conversion member, said controller including, a user-operated input by which the user can enter said program and an actuator operated in accordance with said program to control said adjustment member to adjust said conversion member plane angular orientation to produce said preselected pattern for said selectable force.

58. The device of claim 43 further including a controller which controls operation of said adjustable member according to a user-selected value corresponding to said selectable force, said controller including a user-operated input by which the user can select said selected value, control means for determining the value of said conversion member plane angular orientation which will produce said selectable force corresponding to said selected value, and an actuator responsive to said control means to control said adjustment member to adjust said conversion member plane angular orientation to an angular orientation which produces said selectable force corresponding to said selected value.

59. An exercise device for a human user, comprising:

a first member movable by the user between an initial position and a displaced position, the user achieving exercise by the application of a moving force thereto to move said first member from said initial position to said displaced position, and by the application of a resisting force thereto to resist return movement of said first member from said displaced position toward said initial position;

a resistance member movable between first and second positions which corresponds to said initial and displaced positions of said first member, respectively;

a conversion member converting movement of said first member from said initial position to said displaced position into movement of said resistance member by a responsive distance from said first position to said second position and converting movement of said resistance member said responsive distance from said second position toward said first position to a return force moving said first member from said displaced position toward said initial position as said conversion member moves along a conversion member path having a selectable angular orientation, said angular orientation of said conversion member path being selectively adjustable to a plurality of angular orientations between first and second end limits of adjustment angular orientations, said responsive distance moved by said resistance member being a function of said conversion member path angular orientation, whereby the user moving force required to move said first member from said initial position to said displaced position and the user resisting force required to resist return movement of said first member from said displaced position toward said initial position can be selectively increased or decreased by adjusting said conversion member path angular orientation; and an adjustable member operable to selectively adjust said conversion member path angular orientation between said first and second angular orientations.

60. An exercise device for a human user, comprising:

a first member movable by the user between a rest position and an end limit of travel position, the user achieving exercise by the application of a moving force thereto to move said first member from said rest position to a desired position toward said end-limit position:

a constant weight movable between a lowered position to an elevated position which corresponds to said rest and end-limit positions of said first member, respectively;

a conversion member operatively connecting said first member and said weight to transmit force therebetween as said conversion member moves within a conversion member plane having a selectable angular orientation, said angular orientation of said conversion member plane being selectively adjustable between first and second end-limits of adjustment angular ordinations, said conversion member converting movement of said first member from said rest position to said desired position into movement of said weight by a responsive distance toward said elevated position, said responsive distance moved being a function of said conversion member plane angular orientation, adjustment of said conversion member plane angular orientation between said first and second orientations selectively increasing or decreasing said responsive distance said weigh is moved by said conversion member and thereby the amount of said moving force the user must apply to move said first member to said desired position; and an adjustable member operable to selectively adjust said conversion member plane angular orientation between said first and second angular orientations.

61. The device of claim 60, wherein the user also achieves exercise by the application of a resisting force to said first member to resist return movement of said first member from said desired position toward said rest position, and said conversion member converts the force of said weight as said weight moves said responsive distance from the position to which raised toward said lowered position to a return force moving said first member from said desired position to said rest position, the amount of said return force said weight applies through said conversion member to said first member being a function of said plane conversion member angular orientation, adjustment of said plane conversion member angular orientation between said first and second orientations selectively increasing or decreasing said return force and thereby the amount of said resistance force the user must apply to said first member to resist return movement of said first member from said desired position toward said rest position.

62. The device of claim 60, wherein said adjustable member is an angularly adjustable guide movable between first and second guide angles, and said conversion member is a traveler which moves along said guide with said conversion member plane within which said traveler moves being angularly adjusted by changing the angle of said guide relative to said first guide angle, said traveler coupling more force between said first member and said weight as the angle of said guide is changed relative to said first guide angle.

63. The device of claim 60, wherein said conversion member is a pivot arm pivotally connected to a pivot arm support to pivot about an axis of rotation, and said conversion member plane is a plane through which said pivot arm moves as it pivots about said pivot arm axis, and wherein said adjustable member is coupled to said pivot arm support and selectively moves said pivot arm support to angularly move said pivot arm axis and thereby selectively adjust said conversion member plane angular orientation.

64. An exercise device for a human user, comprising:

a first member movable by the user between a rest position and an end limit of travel position, the user achieving exercise by the application of a moving force thereto to move said first member from said rest position to a desired position toward said end-limit position, and by the application of a resisting force thereto to resist return movement of said first member from said desired position toward said rest position;

means for providing a resistance force which resists movement of said first member from said rest position to said desired position when the user is applying said moving force, and which moves said first member from said desired position to said rest position when the user is applying said resisting force;

conversion means for transmitting a selected portion of said resistance force between said first member and said resistance member as said conversion means moves along a prescribed path having a selectively adjustable angular orientation, said conversion means selectively increasing and decreasing the amount of said selected portion of said resistance force transmitted by said conversion means between said first member and said resistance member in response to the angular orientation selected for said conversion means path, thereby the user moving force required to move said first member from said rest position toward said desired position and the user resisting force required to resist return movement of said first member from said desired position toward said rest position can be selectively increased or decreased by adjusting said conversion means path angular orientation; and adjustment means operable for selectively adjusting said conversion means path angular orientation.

* * * * *

UNITED STATES PATENT AND TRADEMARK OFFICE

CERTIFICATE OF CORRECTION

PATENT NO. : 5,308,303

DATED : May 3, 1994

INVENTOR(S) : R. Lee Rawls and Jeffrey T. Prince

It is certified that error appears in the above-identified patent and that said Letters Patent is hereby corrected as shown below:

In column 20, claim 1, line 17, please delete "ember" and substitute therefor --member--.

In column 21, claim 4, line 27, please delete "arm" and substitute therefor --member--.

In column 21, claim 4, line 28, please delete "member" and substitute therefor --arm--.

In column 22, claim 13, line 34, please delete "f or" and substitute therefor --for--.

In column 24, claim 22, line 6, please delete "form" and substitute therefor --from--.

In column 24, claim 22, line 25, please delete "ember" and substitute therefor --member--.

In column 24, claim 22, line 28, please delete "form" and substitute therefor --from--.

In column 24, claim 27, line 55, please delete "pivotal" and substitute therefor --pivotally--.

In column 25, claim 30, line 23, please delete the first occurring "pivot" and substitute therefor "pivotally".

In column 27, claim 39, line 12, after the first occurring "orientation" and before the second occurring "orientation", please insert --from said first--.

In column 29, claim 53, line 44, after "arm" and before "at a", please insert --coupled--.

UNITED STATES PATENT AND TRADEMARK OFFICE

CERTIFICATE OF CORRECTION

PATENT NO. :

DATED :

INVENTOR(S) :

It is certified that error appears in the above-identified patent and that said Letters Patent is hereby corrected as shown below:

In column 29, claim 56, line 66, please delete "ad le" and substitute therefor --adjustable--.

In column 31, claim 60, line 15, please delete "ordinations" and substitute therefor --orientations--.

In column 31, claim 60, line 25, please delete "weigh" and substitute therefor --weight--.

In column 31, claim 61, line 43, please delete "plane conversion member" and substitute therefor --conversion member plane--.

In column 31, claim 61, line 44, please delete "plane".

In column 31, claim 61, line 45, after "member" and before "angular", please insert --plane--.

Signed and Sealed this

Thirtieth Day of August, 1994

*Attest:*

*Attesting Officer*

Bruce Lehman

BRUCE LEHMAN

*Commissioner of Patents and Trademarks*